US010854151B2

(12) United States Patent
Fukuchi

(10) Patent No.: US 10,854,151 B2
(45) Date of Patent: Dec. 1, 2020

(54) IMAGE PROCESSING DEVICE AND IMAGE PROCESSING METHOD

(71) Applicant: MegaChips Corporation, Osaka (JP)

(72) Inventor: Rui Fukuchi, Chiba (JP)

(73) Assignee: MegaChips Corporation, Osaka (JP)

( * ) Notice: Subject to any disclaimer, the term of this patent is extended or adjusted under 35 U.S.C. 154(b) by 149 days.

(21) Appl. No.: 16/270,340

(22) Filed: Feb. 7, 2019

(65) Prior Publication Data

US 2019/0251915 A1 Aug. 15, 2019

(30) Foreign Application Priority Data

Feb. 9, 2018 (JP) ..... 2018-021985

(51) Int. Cl.
*G09G 3/36* (2006.01)

(52) U.S. Cl.
CPC ..... *G09G 3/36* (2013.01); *G09G 2320/103* (2013.01); *G09G 2330/021* (2013.01); *G09G 2360/18* (2013.01)

(58) Field of Classification Search
CPC ..... G09G 3/36; G09G 2360/18; G09G 2320/103; G09G 2330/021; H04N 5/14; H04N 5/268
See application file for complete search history.

(56) References Cited

U.S. PATENT DOCUMENTS

| | | | | |
|---|---|---|---|---|
| 9,460,685 | B2 * | 10/2016 | Cho | G09G 5/003 |
| 2007/0146281 | A1 | 6/2007 | Hosihara et al. | |
| 2008/0303758 | A1 | 12/2008 | Ooishi et al. | |
| 2013/0307835 | A1 * | 11/2013 | Wu | G09G 3/3611 345/212 |
| 2016/0117995 | A1 * | 4/2016 | Lee | G09G 3/20 345/691 |

FOREIGN PATENT DOCUMENTS

| | | | |
|---|---|---|---|
| JP | 2005-164937 | A | 6/2005 |
| JP | 2007-148054 | A | 6/2007 |
| JP | 2007-199418 | A | 8/2007 |
| JP | 2008-304763 | A | 12/2008 |

* cited by examiner

*Primary Examiner* — Jonathan A Boyd
(74) *Attorney, Agent, or Firm* — Osha Bergman Watanabe & Burton LLP

(57) ABSTRACT

In the image processing device, to display, by the panel self-refresh, a still image corresponding to the image data having undergone the image processing, the switch signal generating circuit generates the switch signal controlling switching of the image data selected by the first to fourth switch circuits such that the input image data is subjected to the image processing by the first image processing circuit, that the image data having undergone the image processing is written in the frame buffer through control by the panel self-refresh control circuit, and that the image data having undergone the image processing as read out from the frame buffer is output from the fourth switch circuit or the image data having undergone the image processing is output from the fourth switch circuit via the third switch circuit.

10 Claims, 13 Drawing Sheets

IMAGE PROCESSING DEVICE AND IMAGE PROCESSING METHOD

CROSS-REFERENCE TO RELATED APPLICATIONS

The present application claims priority under 35 U.S.C. § 119 to Japanese Patent Application No. 2018-021985, filed on Feb. 9, 2018. The above application is hereby expressly incorporated by reference, in its entirety, into the present application.

BACKGROUND OF THE INVENTION

The present invention relates to an image processing device and an image processing method for displaying an image corresponding to input image data on an image display device such as a liquid crystal panel by using a panel self-refresh function.

Embedded DisplayPort (eDP), which is a standard developed by the standards organization Video Electronics Standards Association (VESA), includes a power saving technology called Panel Self-Refresh (PSR). In PSR, when a still image is displayed, the operation of an input image data transmitting device is stopped, and image data of the still image stored in an image processing device on an input image data receiving device side is output, thereby reducing power consumption of the whole system.

The eDP standard also includes a function of Panel Self-Refresh 2 (PSR2). In PSR2, while display of a still image by PSR is maintained, the image is updated. There are two different types of image update, such as updating the entire image and updating only a partial region of an image. While updating only a partial region is superior from a power saving viewpoint, this method requires, for instance, selection of a partial region to be updated, storage of image data, and switching of image data to be output.

An image processing device that causes a still image to be displayed on a display device using the panel self-refresh functions, that is, PSR and PSR2, has a remote frame buffer that stores image data of the still image. When causing a new image to be displayed, the image processing device selects whether to output input image data transmitted from a transmitter or image data of a still image read out from the remote frame buffer. The image processing device also selects whether to rewrite the entire image or only a partial region of the image.

U.S. Pat. No. 9,460,685 B, JP 2005-164937 A, JP 2007-199418 A, JP 2008-304763 A and JP 2007-148054 A are noted as conventional art literatures related to the present invention.

SUMMARY OF THE INVENTION

Meanwhile, for subjecting image data to image processing in an image processing device, there are image processing applicable to a partial image that is a partial region of an image and image processing in which information needs to be extracted from the entire image to carry out processing. Specifically, correction or other processing necessitated in connection with an image processing device is unchanged regardless of the image and therefore applicable to a partial image. On the other hand, correction or other processing necessitated in connection with movement and change in an image requires information from the entire image and therefore needs to be applied to the entire image.

In a conventional image processing device, regardless of whether image processing is performed on a partial image or the entire image, image processing is carried out on image data read out from a remote frame buffer. Thus, even when a still image whose entire region is subjected to image processing is displayed by PSR, an image processing circuit performing image processing on image data cannot be stopped, and therefore power consumption of the image processing circuit cannot be reduced, disadvantageously.

A first object of the present invention is to provide an image processing device and an image processing method capable of, when a still image whose entire region is subjected to image processing is displayed by PSR, stopping an image processing circuit to thereby reduce power consumption.

In addition to the first object above, a second object of the present invention is to provide an image processing device and an image processing method capable of, when a still image whose partial region is subjected to image processing is displayed by PSR2, stopping an image processing circuit to thereby reduce power consumption.

In order to achieve the above objects, the invention provides an image processing device that causes an image corresponding to input image data to be displayed on an image display device by using a panel self-refresh function including panel self-refresh (PSR) and panel self-refresh 2 (PSR2), the image processing device comprising:

a panel self-refresh control circuit configured to control the panel self-refresh function;

a first image processing circuit configured to perform, on selected image data, image processing applied to an image corresponding to the selected image data;

a switch signal generating circuit configured to generate a switch signal controlling switching of image data;

a first switch circuit configured to, in response to the switch signal, switch between the input image data and image data read out from a frame buffer through control by the panel self-refresh control circuit so as to output one of the input image data and the image data read out;

a second switch circuit and a third switch circuit each configured to, in response to the switch signal, switch between the input image data and the image data having undergone the image processing so as to output one of the input image data and the image data having undergone the image processing; and a fourth switch circuit configured to, in response to the switch signal, switch between image data output from the third switch circuit and the image data read out from the frame buffer so as to output one of the image data output from the third switch circuit and the image data read out, wherein, to display, by the panel self-refresh, a still image corresponding to the image data having undergone the image processing, the switch signal generating circuit generates the switch signal controlling switching of the selected image data such that the input image data is input, via the first switch circuit, to the first image processing circuit to be subjected to the image processing, that the image data having undergone the image processing is input, via the second switch circuit, to the panel self-refresh control circuit to be written in the frame buffer through control by the panel self-refresh control circuit, and that the image data having undergone the image processing as read out from the frame buffer is output from the fourth switch circuit or the image data having undergone the image processing is output from the fourth switch circuit via the third switch circuit.

Here, it is preferable that, to display, by the panel self-refresh 2, a still image corresponding to the image data having undergone the image processing, the switch signal generating circuit generates the switch signal controlling switching of the selected image data such that the input image data is input, via the second switch circuit, to the panel self-refresh control circuit to be written in the frame buffer, that the input image data is input, via the first switch circuit, to the first image processing circuit to be subjected to the image processing or the image data read out from the frame buffer is input, via the first switch circuit, to the first image processing circuit to be subjected to the image processing, and that the image data having undergone the image processing is output from the fourth switch circuit via the third switch circuit.

Also, it is preferable that the frame buffer has a first frame region and a second frame region that store image data for two frames, and to display, by the panel self-refresh 2, a still image corresponding to the image data having undergone the image processing, the switch signal generating circuit generates the switch signal controlling switching of the selected image data such that image data read out from the second frame region of the frame buffer is input, via the first switch circuit, to the first image processing circuit to be subjected to the image processing, and that the image data having undergone the image processing is input, via the second switch circuit, to the panel self-refresh control circuit to be written in the first frame region of the frame buffer, whereafter the image data having undergone the image processing as read out from the first frame region of the frame buffer is output from the fourth switch circuit or the image data having undergone the image processing is output from the fourth switch circuit via the third switch circuit.

Also, it is preferable that, to display, by normal operation, an image corresponding to the image data having undergone the image processing, the switch signal generating circuit generates the switch signal controlling switching of the selected image data such that the input image data is input, via the first switch circuit, to the first image processing circuit to be subjected to the image processing and that the image data having undergone the image processing is output from the fourth switch circuit via the third switch circuit.

Also, it is preferable that, to display, by normal operation, an image corresponding to image data not subjected to the image processing, the switch signal generating circuit generates the switch signal controlling switching of the selected image data such that the input image data is output from the fourth switch circuit via the third switch circuit without any change.

Also, it is preferable that, to display, by the panel self-refresh or the panel self-refresh 2, an image corresponding to image data not subjected to the image processing, the switch signal generating circuit generates the switch signal controlling switching of the selected image data such that the input image data is input, via the second switch circuit, to the panel self-refresh control circuit to be written in the frame buffer, whereafter the image data read out from the frame buffer is output from the fourth switch circuit.

Also, it is preferable that the switch signal generating circuit generates, as the switch signal, a first switch signal that controls switching of image data in the first switch circuit such that the input image data is output in a normal operation mode where an image corresponding to the input image data is displayed by normal operation, a panel self-refresh start mode where the input image data is written in the frame buffer before the panel self-refresh starts, a panel self-refresh end mode where phase adjustment between the input image data and the image data read out from the frame buffer is carried out before the panel self-refresh ends, and a panel self-refresh 2 start mode where the input image data is written in the frame buffer before the panel self-refresh 2 starts, and the image data read out from the frame buffer is output in a panel self-refresh 2 mode where a still image is displayed by the panel self-refresh 2, and a panel self-refresh 2 end mode where phase adjustment between the input image data and the image data read out from the frame buffer is carried out before the panel self-refresh 2 ends, when the image processing is performed, a second switch signal that controls switching of image data in the second switch circuit such that the input image data is output in the panel self-refresh start mode, the panel self-refresh end mode, the panel self-refresh 2 start mode and the panel self-refresh 2 end mode when the image processing is not performed, and that the input image data is output in the panel self-refresh 2 start mode and the panel self-refresh 2 end mode, and the image data having undergone the image processing is output in the panel self-refresh start mode and the panel self-refresh end mode, when the image processing is performed, a third switch signal that controls switching of image data in the third switch circuit such that the input image data is output in the normal operation mode, the panel self-refresh start mode, the panel self-refresh end mode, the panel self-refresh 2 start mode and the panel self-refresh 2 end mode when the image processing is not performed, and that the image data having undergone the image processing is output in the normal operation mode, the panel self-refresh start mode, the panel self-refresh end mode, the panel self-refresh 2 start mode, the panel self-refresh 2 mode and the panel self-refresh 2 end mode when the image processing is performed, and a fourth switch signal that controls switching of image data in the fourth switch circuit such that image data output from the third switch circuit is output in the normal operation mode, the panel self-refresh start mode and the panel self-refresh 2 start mode when the image processing is not performed and in the normal operation mode, the panel self-refresh start mode, the panel self-refresh 2 start mode, the panel self-refresh 2 mode and the panel self-refresh 2 end mode when the image processing is performed, and that the image data read out from the frame buffer is output in a panel self-refresh mode where a still image is displayed by the panel self-refresh, the panel self-refresh end mode, the panel self-refresh 2 mode and the panel self-refresh 2 end mode when the image processing is not performed and in the panel self-refresh mode and the panel self-refresh end mode when the image processing is performed.

Also, it is preferable that the image processing device further including a second image processing circuit configured to perform, on image data output from the fourth switch circuit, image processing applied to an entire region of an image corresponding to the input image data.

Also, it is preferable that the first image processing circuit is stopped after the image data having undergone the image processing is written in the frame buffer.

Also, the invention provides an image processing method that causes an image corresponding to input image data to be displayed on an image display device by using a panel self-refresh function including panel self-refresh (PSR) and panel self-refresh 2 (PSR2) by means of an image processing device, the image processing method comprising:

a step of controlling the panel self-refresh function, by means of a panel self-refresh control circuit of the image processing device;

a step of performing, on selected image data, image processing applied to an image corresponding to the selected image data, by means of a first image processing circuit of the image processing device;

a step of generating a switch signal controlling switching of image data, by means of a switch signal generating circuit of the image processing device;

a step of, in response to the switch signal, switching between the input image data and image data read out from a frame buffer through control by the panel self-refresh control circuit so as to output one of the input image data and the image data read out, by means of a first switch circuit of the image processing device;

a step of, in response to the switch signal, switching between the input image data and the image data having undergone the image processing so as to output one of the input image data and the image data having undergone the image processing, by means of a second switch circuit of the image processing device;

a step of, in response to the switch signal, switching between the input image data and the image data having undergone the image processing so as to output one of the input image data and the image data having undergone the image processing, by means of a third switch circuit of the image processing device; and a step of, in response to the switch signal, switching between image data output from the third switch circuit and the image data read out from the frame buffer so as to output one of the image data output from the third switch circuit and the image data read out, by means of a fourth switch circuit of the image processing device, wherein the step of generating the switch signal includes:

a step of generating, as the switch signal, a first switch signal that controls switching of image data in the first switch circuit such that the input image data is output in a normal operation mode where an image corresponding to the input image data is displayed by normal operation, a panel self-refresh start mode where the input image data is written in the frame buffer before the panel self-refresh starts, a panel self-refresh end mode where phase adjustment between the input image data and the image data read out from the frame buffer is carried out before the panel self-refresh ends, and a panel self-refresh 2 start mode where the input image data is written in the frame buffer before the panel self-refresh 2 starts, and the image data read out from the frame buffer is output in a panel self-refresh 2 mode where a still image is displayed by the panel self-refresh 2, and a panel self-refresh 2 end mode where phase adjustment between the input image data and the image data read out from the frame buffer is carried out before the panel self-refresh 2 ends, when the image processing is performed, a step of generating, as the switch signal, a second switch signal that controls switching of image data in the second switch circuit such that the input image data is output in the panel self-refresh start mode, the panel self-refresh end mode, the panel self-refresh 2 start mode and the panel self-refresh 2 end mode when the image processing is not performed, and that the input image data is output in the panel self-refresh 2 start mode and the panel self-refresh 2 end mode, and the image data having undergone the image processing is output in the panel self-refresh start mode and the panel self-refresh end mode, when the image processing is performed, a step of generating, as the switch signal, a third switch signal that controls switching of image data in the third switch circuit such that the input image data is output in the normal operation mode, the panel self-refresh start mode, the panel self-refresh end mode, the panel self-refresh 2 start mode and the panel self-refresh 2 end mode when the image processing is not performed, and that the image data having undergone the image processing is output in the normal operation mode, the panel self-refresh start mode, the panel self-refresh end mode, the panel self-refresh 2 start mode, the panel self-refresh 2 mode and the panel self-refresh 2 end mode when the image processing is performed, and a step of generating, as the switch signal, a fourth switch signal that controls switching of image data in the fourth switch circuit such that image data output from the third switch circuit is output in the normal operation mode, the panel self-refresh start mode and the panel self-refresh 2 start mode when the image processing is not performed and in the normal operation mode, the panel self-refresh start mode, the panel self-refresh 2 start mode, the panel self-refresh 2 mode and the panel self-refresh 2 end mode when the image processing is performed, and that the image data read out from the frame buffer is output in a panel self-refresh mode where a still image is displayed by the panel self-refresh, the panel self-refresh end mode, the panel self-refresh 2 mode and the panel self-refresh 2 end mode when the image processing is not performed and in the panel self-refresh mode and the panel self-refresh end mode when the image processing is performed.

According to the present invention, to display a still image corresponding to image-processed image data (the image data having undergone the image processing) by PSR, image data is subjected to image processing in the first image processing circuit, the image-processed image data is written in the frame buffer through control by the panel self-refresh control circuit, and the image-processed image data read out from the frame buffer is output from the fourth switch circuit.

Thus, when a still image whose entire region is subjected to image processing is displayed by PSR, the first image processing circuit can be stopped, and power consumption of the first image processing circuit can be reduced accordingly.

Aside from that, according to the present invention, to display a still image corresponding to image-processed image data by PSR2, image data read out from the second frame region of the frame buffer through control by the PSR control circuit is subjected to image processing in the first image processing circuit, the image-processed image data is written in the first frame region of the frame buffer through control by the PSR control circuit, and then the image-processed image data read out from the first frame region of the frame buffer is output from the fourth switch circuit.

Thus, when a still image subjected to image processing is displayed by PSR2, the first image processing circuit can be stopped, and power consumption of the first image processing circuit can be reduced accordingly.

DETAILED DESCRIPTION OF THE INVENTION

An image processing device and an image processing method according to the invention are described below in detail with reference to a preferred embodiment shown in the accompanying drawings.

Figure 1:
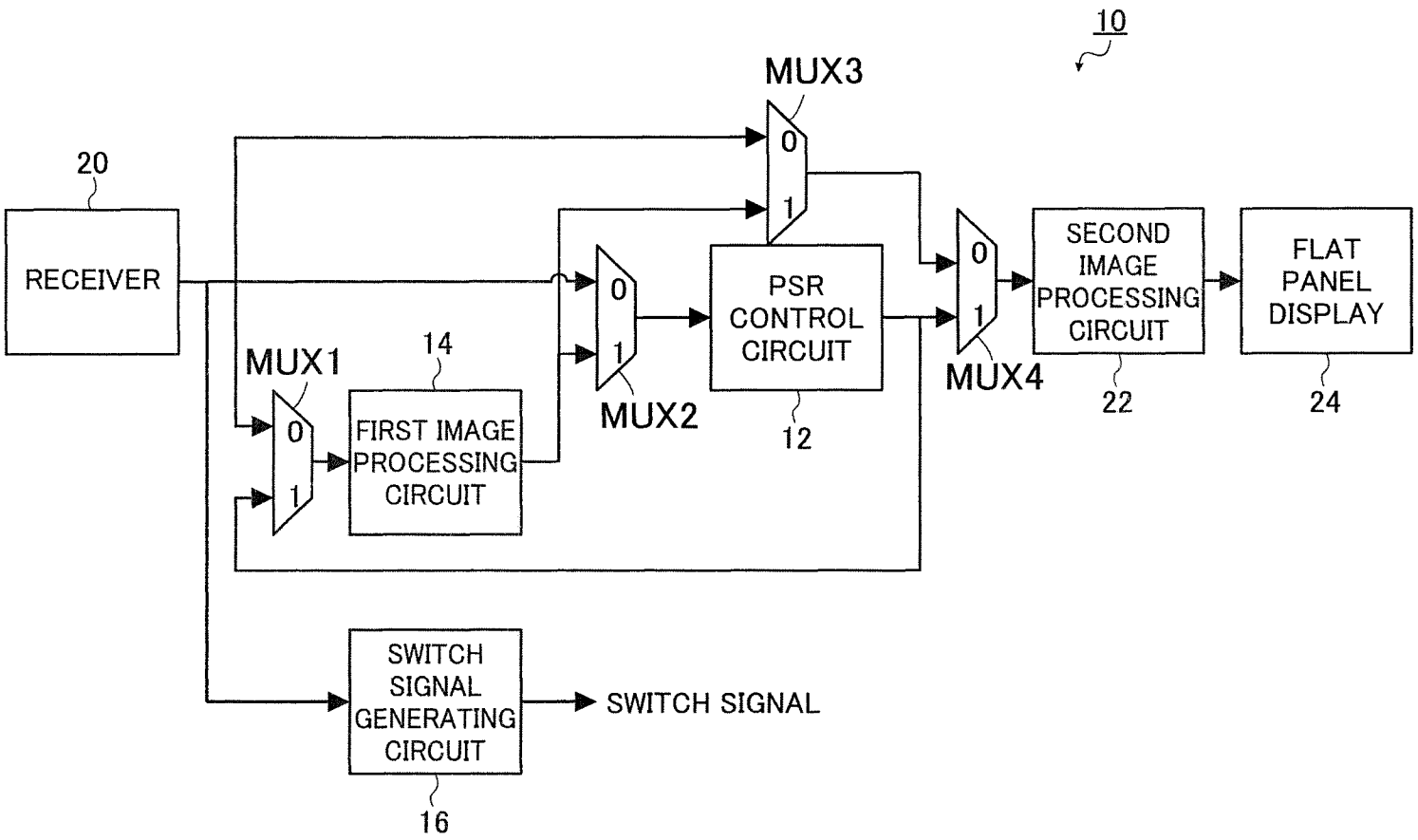
FIG. 1 is a block diagram showing an embodiment of the configuration of an image processing device of the invention.

FIG. 1 is a block diagram showing an embodiment of the configuration of an image processing device of the invention. An image processing device 10 shown in FIG. 1 causes an image corresponding to input image data to be displayed on an image display device such as a liquid crystal panel by using a panel self-refresh function including PSR and PSR2. The image processing device 10 includes a panel self-refresh control circuit (hereinafter also called "PSR control circuit") 12, a first image processing circuit 14, a switch signal generating circuit 16, switch circuits, and a second image processing circuit 22.

In FIG. 1, a receiver 20 receives input image data, control signals and the like transmitted from a transmitter (not shown). Input image data, control signals and the like output from the receiver 20 are input to the image processing device 10.

In the image processing device 10, the PSR control circuit 12 controls the panel self-refresh function.

To the PSR control circuit 12, image data output from a switch circuit is input. Image data output from the PSR control circuit 12 is input to switch circuits.

Specifically, to display a still image by PSR or PSR2, the PSR control circuit 12 controls writing and reading image data to and from a remote frame buffer RFB (which is a frame buffer of the invention).

In addition, the PSR control circuit 12 outputs, as detection signals, a one-frame passing signal and a phase adjustment completion signal, which will be described later.

The PSR control circuit 12 in this embodiment has therein the remote frame buffer RFB that stores image data for one frame, however, having the remote frame buffer RFB inside is not essential, and an exterior remote frame buffer RFB may be used.

The first image processing circuit (IPU1) 14 performs image processing on image data selected by a switch circuit.

To the first image processing circuit 14, image data output from the switch circuit is input. Image data output from the first image processing circuit 14 is input to switch circuits.

The first image processing circuit 14 performs, on image data, image processing applied to a partial region of an image corresponding to image data, such as correction or other processing necessitated in connection with a liquid crystal panel, and image processing applied to the entire region of an image corresponding to image data, such as correction or other processing necessitated in connection with movement and change in the image.

The switch signal generating circuit 16 generates a switch signal controlling switching of image data through the switch circuits.

To the switch signal generating circuit 16, a control signal output from the receiver 20 is input. A switch signal output from the switch signal generating circuit 16 is input to the switch circuits.

In this embodiment, the switch signal generating circuit 16 generates first to fourth switch signals.

The switch circuits are used to switch image data, i.e., select and output image data in accordance with switch signals generated by the switch signal generating circuit 16. The switch circuits comprise first to fourth multiplexers MUX1 to MUX4 serving as first to fourth switch circuits.

The switch circuits in this embodiment use the first to fourth multiplexers MUX1 to MUX4 to, in accordance with the first to fourth switch signals, switch image data to be input to the PSR control circuit 12 and the first image processing circuit 14, that is, image data output from the first and second multiplexers MUX1 and MUX2, as well as image data output from the third multiplexer MUX3 and image data output from the fourth multiplexer MUX4.

In response to the first switch signal, the first multiplexer MUX1 switches between input image data output from the receiver 20 and image data read out from the remote frame buffer RFB through control by the PSR control circuit 12 and outputs the selected image data.

Input image data output from the receiver 20 is input to an input terminal 0 of the first multiplexer MUX1, image data read out from the remote frame buffer RFB is input to an input terminal 1 of the same, and the first switch signal is input to a selection input terminal of the same. Image data output from the first multiplexer MUX1 is input to the first image processing circuit 14.

In response to the second switch signal, the second multiplexer MUX2 switches between input image data output from the receiver 20 and image-processed image data output from the first image processing circuit 14 and outputs the selected image data.

Input image data output from the receiver 20 is input to an input terminal 0 of the second multiplexer MUX2, the image-processed image data output from the first image processing circuit 14 is input to an input terminal 1 of the same, and the second switch signal is input to a selection input terminal of the same. Image data output from the second multiplexer MUX2 is input to the PSR control circuit 12, i.e., the remote frame buffer RFB.

In response to the third switch signal, the third multiplexer MUX3 switches between input image data output from the receiver 20 and image-processed image data output from the first image processing circuit 14 and outputs the selected image data.

Input image data output from the receiver 20 is input to an input terminal 0 of the third multiplexer MUX3, image-processed image data output from the first image processing circuit 14 is input to an input terminal 1 of the same, and the third switch signal is input to a selection input terminal of the same. Image data output from the third multiplexer MUX3 is input to the fourth multiplexer MUX4.

In response to the fourth switch signal, the fourth multiplexer MUX4 switches between image data output from the third multiplexer MUX3 and image data read out from the remote frame buffer RFB through control by the PSR control circuit 12 and outputs the selected image data.

Image data output from the third multiplexer MUX3 is input to an input terminal 0 of the fourth multiplexer MUX4, image data read out from the remote frame buffer RFB is input to an input terminal 1 of the same, and the fourth switch signal is input to a selection input terminal of the same. Image data output from the fourth multiplexer MUX4 is input to the second image processing circuit 22.

The second image processing circuit (IPU2) 22 performs image processing on image data output from the switch circuit, i.e., the fourth multiplexer MUX4.

To the second image processing circuit 22, image data output from the fourth multiplexer MUX4 is input, and image-processed image data output from the second image processing circuit 22 is input to a flat panel display 24.

The second image processing circuit 22 performs, on image data, image processing applied to the entire region of an image corresponding to the image data, such as correction or other processing necessitated in connection with movement and change in the image. The second image processing circuit 22 is not an essential component and may be provided as needed. On an image not subjected to image processing in the first image processing circuit 14, the second image processing circuit 22 may perform the same image processing as that of the first image processing circuit 14 and then image processing of the second image processing circuit 22.

The flat panel display 24 has a timing controller (not shown) therein. The timing controller controls the timing of displaying an image corresponding to image data output from the second image processing circuit 22 on the flat panel display 24.

To the flat panel display 24, image-processed image data output from the second image processing circuit 22 is input. Image-processed image data output from the second image processing circuit 22 is supplied to the timing controller, and an image corresponding to the image-processed image data is displayed on the flat panel display 24 through control by the timing controller.

Next, operation modes of the image processing device 10 are described.

TABLE 1

| Operation mode | MUX1 | MUX2 | MUX3 | MUX4 |
|---|---|---|---|---|
| Normal Operation | −(0) | −(0) | 0 | 0 |
| PSR Entry | −(0) | 0 | 0 | 0 |
| PSR | −(0) | −(0) | −(0) | 1 |
| PSR Exit | −(0) | 0 | 0 | 1 |
| PSR2 Entry | −(0) | 0 | 0 | 0 |
| PSR2 | −(0) | −(0) | −(0) | 1 |
| PSR2 Exit | −(0) | 0 | 0 | 1 |
| Normal Operation with IPU1 | 0 | −(1) | 1 | 0 |
| PSR Entry with IPU1 | 0 | 1 | 1 | 0 |

TABLE 1-continued

| Operation mode | MUX1 | MUX2 | MUX3 | MUX4 |
|---|---|---|---|---|
| PSR with IPU1 | −(0) | −(1) | −(1) | 1 |
| PSR Exit with IPU1 | 0 | 1 | 1 | 1 |
| PSR2 Entry with IPU1 | 0 | 0 | 1 | 0 |
| PSR2 with IPU1 | 1 | −(0) | 1 | 0 |
| PSR2 Exit with IPU1 | 1 | 0 | 1 | 0 |

In Table 1, the leftmost column shows operation modes of the image processing device 10, and the four right columns show examples of settings of the first to fourth switch signals corresponding to the relevant operation modes.

The image processing device 10 has such operation modes as a normal operation mode (Normal Operation), a PSR start mode (PSR Entry), a PSR mode (PSR), a PSR end mode (PSR Exit), a PSR2 start mode (PSR2 Entry), a PSR2 mode (PSR2) and a PSR2 end mode (PSR2 Exit) as shown in Table 1. Each of the operation modes includes two patterns: the mode with no image processing being performed on images by the first image processing circuit 14; and the mode with image processing being performed on images by the same (with IPU1).

The normal operation mode is a mode in which the normal operation where a still image is not displayed by PSR or PSR2 is carried out, that is, input image data output from the receiver 20 is output without any change, so that an image corresponding to the input image data is displayed.

The PSR start mode is a mode in which, before PSR starts (i.e., the PSR mode starts), input image data for one frame to be read out in the PSR mode is written in the remote frame buffer RFB. In the PSR start mode, input image data corresponding to the entire region of an image is sent from the transmitter, and the receiver 20 takes the sent data therein.

The PSR mode is a mode in which image data for one frame written in the remote frame buffer RFB in the PSR start mode is read out from the remote frame buffer RFB, and a still image is displayed by PSR. In the PSR mode, the transmitter can send input image data for one frame to the receiver 20, whereupon the receiver 20 stores a new still image in the remote frame buffer RFB.

The PSR end mode is a mode in which, before PSR ends (i.e., the PSR mode ends), phase adjustment between input image data output from the receiver 20 and image data read out from the remote frame buffer RFB is carried out in order to switch image data on frame basis in a vertical blanking interval.

The PSR2 start mode is a mode in which, before PSR2 starts (i.e., the PSR2 mode starts), input image data for one frame to be read out in the PSR2 mode is written in the remote frame buffer RFB. In the PSR2 start mode, input image data corresponding to the entire region of an image is sent from the transmitter, and the receiver 20 takes in the sent data.

The PSR2 mode is a mode in which image data for one frame containing image data corresponding to the entire region of an image, as written in the remote frame buffer RFB in the PSR2 start mode, is read out from the remote frame buffer RFB, and a still image is displayed by PSR2. In the PSR2 mode, the transmitter can send input image data of the entire region or only a partial region of an image, whereupon the remote frame buffer RFB is updated.

The PSR2 end mode is a mode in which, before PSR2 ends (i.e., the PSR2 mode ends), phase adjustment between input image data output from the receiver 20 and image data read out from the remote frame buffer RFB is carried out in order to switch image data on frame basis in the vertical blanking interval.

As shown in Table 1, the first switch signal is set to "0" in the normal operation mode, PSR start mode, PSR end mode and PSR2 start mode with image processing being performed on images. The first switch signal is set to "1" in the PSR2 mode and PSR2 end mode with image processing being performed on images.

When the first switch signal is "0", input image data output from the receiver 20 is output from the first multiplexer MUX1. When the first switch signal is "1", image data read out from the remote frame buffer RFB is output from the first multiplexer MUX1.

The second switch signal is set to "0" in the PSR start mode, PSR end mode, PSR2 start mode and PSR2 end mode with no image processing being performed on images as well as in the PSR2 start mode and PSR2 end mode with image processing being performed on images. The second switch signal is set to "1" in the PSR start mode and PSR end mode with image processing being performed on images.

When the second switch signal is "0", input image data output from the receiver 20 is output from the second multiplexer MUX2. When the second switch signal is "1", image-processed image data output from the first image processing circuit 14 is output from the second multiplexer MUX2.

The third switch signal is set to "0" in the normal operation mode, PSR start mode, PSR end mode, PSR2 start mode and PSR2 end mode with no image processing being performed on images. The third switch signal is set to "1" in the normal operation mode, PSR start mode, PSR end mode, PSR2 start mode, PSR2 mode and PSR2 end mode with image processing being performed on images.

When the third switch signal is "0", input image data output from the receiver 20 is output from the third multiplexer MUX3. When the third switch signal is "1", image-processed image data output from the first image processing circuit 14 is output from the third multiplexer MUX3.

The fourth switch signal is set to "0" in the normal operation mode, PSR start mode and PSR2 start mode with no image processing being performed on images as well as in the normal operation mode, PSR start mode, PSR2 start mode, PSR2 mode and PSR2 end mode with image processing being performed on images. The fourth switch signal is set to "1" in the PSR mode, PSR end mode, PSR2 mode and PSR2 end mode with no image processing being performed on images as well as in the PSR mode and PSR end mode with image processing being performed on images.

When the fourth switch signal is "0", image data output from the third multiplexer MUX3 is output from the fourth multiplexer MUX4. When the fourth switch signal is "1", image data output from the remote frame buffer RFB is output from the fourth multiplexer MUX4.

Next, shifting of the operation mode of the image processing device 10 is described.

TABLE 2

| Current operation mode | Subsequent operation mode | Trigger to shift operation mode |
|---|---|---|
| Normal Operation | PSR Entry with IPU1 | IPU1 Enable + PSR Active |
| | PSR2 Entry with IPU1 | IPU1 Enable + PSR2 Active |
| | PSR Entry | PSR Active |
| | PSR2 Entry | PSR2 Active |

TABLE 2-continued

| Current operation mode | Subsequent operation mode | Trigger to shift operation mode |
|---|---|---|
| | Normal Operation with IPU1 | IPU1 Enable |
| PSR Entry | Normal Operation | PSR Inactive |
| | PSR | One-frame passing |
| PSR | PSR Exit | PSR Inactive |
| PSR Exit | Normal Operation | Phase adjustment completion |
| | PSR | PSR Active |
| | PSR2 | PSR2 Active |
| PSR2 Entry | Normal Operation | PSR2 Inactive |
| | PSR2 | One-frame passing |
| PSR2 | PSR2 Exit | PSR2 Inactive |
| PSR2 Exit | Normal Operation | Phase adjustment completion |
| | PSR | PSR Active |
| | PSR2 | PSR2 Active |
| Normal Operation with IPU1 | PSR Entry with IPU1 | PSR Active |
| | PSR2 Entry with IPU1 | PSR2 Active |
| | PSR Entry | IPU1 Disable + PSR Active |
| | PSR2 Entry | IPU1 Disable + PSR2 Active |
| | Normal Operation | IPU1 Disable |
| PSR Entry with IPU1 | Normal Operation with IPU1 | PSR Inactive |
| | PSR with IPU1 | One-frame passing |
| PSR with IPU1 | PSR Exit with IPU1 | PSR Inactive |
| PSR Exit with IPU1 | Normal Operation with IPU1 | Phase adjustment completion |
| | PSR with IPU1 | PSR Active |
| | PSR2 with IPU1 | PSR2 Active |
| PSR2 Entry with IPU1 | Normal Operation with IPU1 | PSR2 Inactive |
| | PSR2 with IPU1 | One-frame passing |
| PSR2 with IPU1 | PSR2 Exit with IPU1 | PSR2 Inactive |
| PSR2 Exit with IPU1 | Normal Operation with IPU1 | Phase adjustment completion |
| | PSR2 with IPU1 | PSR Active |
| | PSR2 with IPU1 | PSR2 Active |

In Table 2, the left column shows current operation modes, the right column shows signals each serving as a trigger to shift the operation mode, and the middle column shows subsequent operation modes to be implemented upon detection of the relevant signal serving as a trigger.

The first to fourth switch signals shown in Table 1 are generated based on an IPU1 Enable signal, an IPU1 Disable signal, a PSR Active signal, a PSR Inactive signal, a PSR2 Active signal and a PSR2 Inactive signal which are control signals sent from the transmitter and received by the receiver 20 and a one-frame passing signal and a phase adjustment completion signal which are detection signals output from the PSR control circuit 12, as shown in Table 2.

The IPU1 Enable signal and the IPU1 Disable signal are exemplary control signals giving instructions to perform or not perform image processing on an image in the image processing device 10. The IPU1 Enable signal is a signal giving an instruction to perform image processing on an image in order to, for instance, display the image in High Dynamic Range (HDR), while the IPU1 Disable signal is a signal giving an instruction to not perform image processing on an image in order to, for instance, display the image in Standard Dynamic Range (SDR).

The PSR Active signal is a signal giving an instruction to display a still image by PSR, while the PSR Inactive signal is a signal giving an instruction to not display a still image by PSR.

The PSR2 Active signal is a signal giving an instruction to display a still image by PSR2, while the PSR2 Inactive signal is a signal giving an instruction to not display a still image by PSR2.

The one-frame passing signal is a signal output after image data for one frame is written in the remote frame buffer RFB in the PSR start mode and the PSR2 start mode.

The phase adjustment completion signal is a signal output after phase adjustment between input image data output from the receiver 20 and image data read out from the remote frame buffer RFB is completed in the PSR end mode and the PSR2 end mode.

As shown in Table 2, when, for example, the IPU1 Enable signal is detected and successively the PSR Active signal is detected in the normal operation mode with no image processing being performed, the image processing device 10 shifts to the PSR start mode with image processing being performed. The operation mode of the image processing device 10 shifts in the same manner also in other cases.

When the PSR Active signal is detected in the PSR2 end mode with image processing being performed, the image processing device 10 shifts not to the PSR mode with image processing being performed but to the PSR2 mode with image processing being performed.

Figure 2:
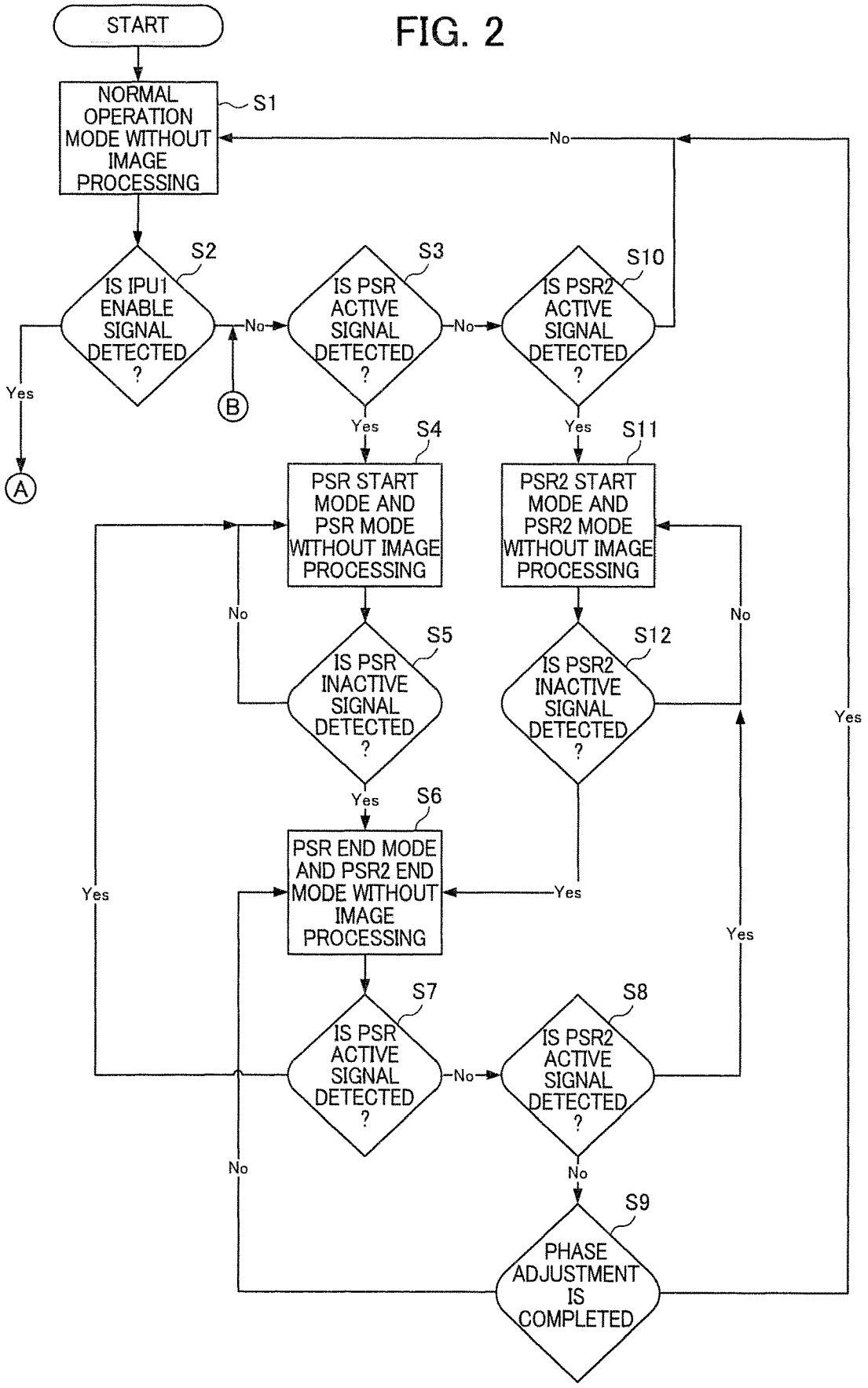
FIG. 2 is a flowchart showing the operation of the image processing device shown in FIG. 1.
Figure 3:
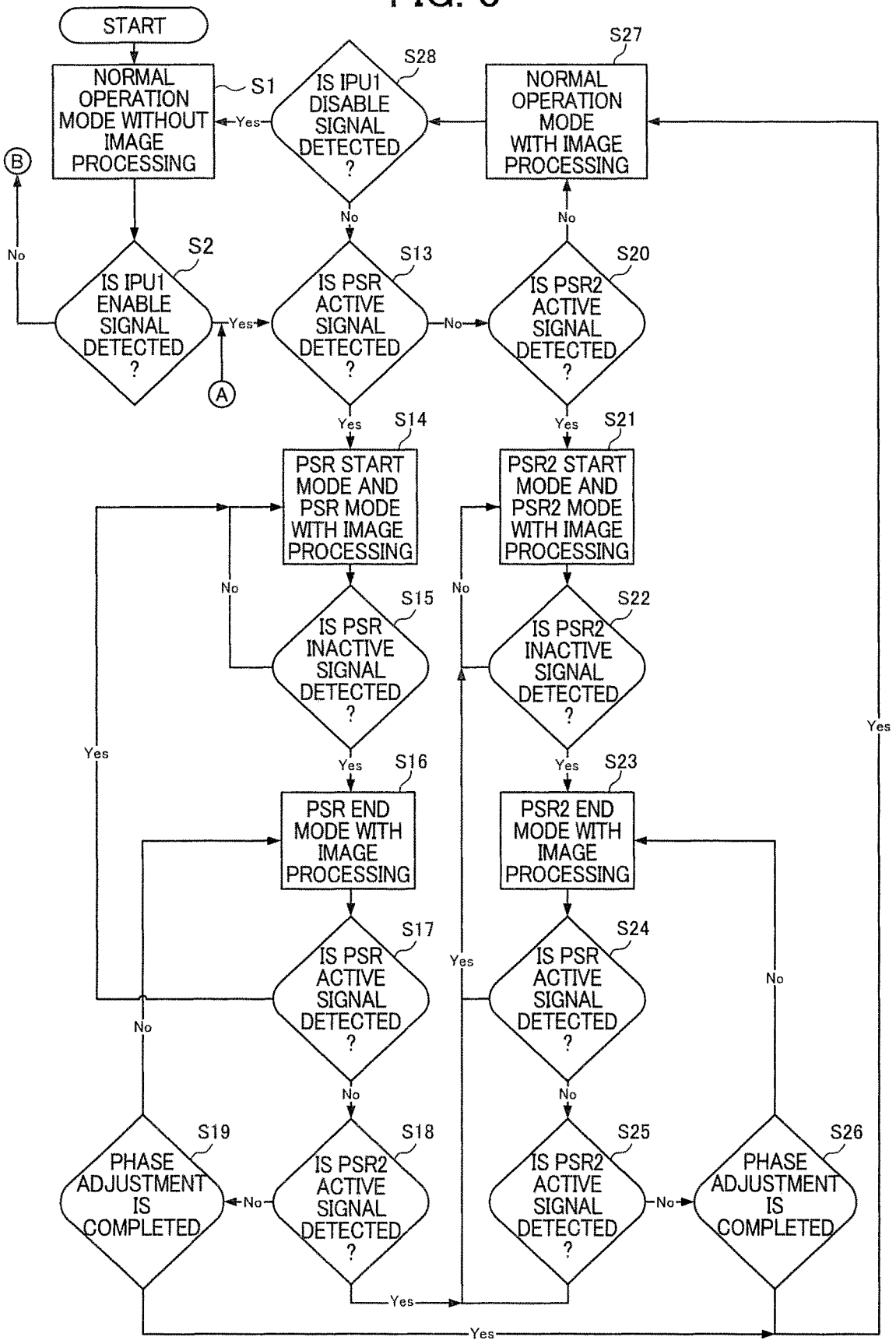
FIG. 3 is a flowchart showing the operation of the image processing device shown in FIG. 1.

Next, the operation of the image processing device 10 is described with reference to the flowcharts shown in FIGS. 2 and 3.

In this embodiment, it is assumed that the operation starts from the normal operation mode with no image processing being performed on images (Step S1).

The third and fourth switch signals are set to "0" in the normal operation mode with no image processing being performed, as shown in Table 1.

In this case, input image data output from the receiver 20 is output from the third multiplexer MUX3, and the image data output from the third multiplexer MUX3, that is, the input image data output from the receiver 20 is output from the fourth multiplexer MUX4 without any change. The image data output from the fourth multiplexer MUX4 is subjected to image processing in the second image processing circuit 22, and an image corresponding to the image-processed image data output from the second image processing circuit 22 is displayed on the flat panel display 24 through control by the timing controller. At this time, the remote frame buffer RFB is empty.

In other words, to display an image corresponding to image data not subjected to image processing by the normal operation, the switch signal generating circuit 16 generates switch signals controlling switching of selected image data such that input image data is output from the fourth multiplexer MUX4 via the third multiplexer MUX3 without any change.

Note that the first and second switch signals may be set to "0" or "1" in the normal operation mode with no image processing being performed. In Table 1, "–(0)" is given when a switch signal is set to "0" in the case where either "0" or "1" is fine, and "–(1)" is given when a switch signal is set to "1" in the same case. The same applies to subsequent operation modes.

Next, it is detected whether the IPU1 Enable signal is received (Step S2).

When the IPU1 Enable signal is not received in the normal operation mode with no image processing being performed (No in Step S2), it is detected whether the PSR Active signal is received (Step S3).

When the PSR Active signal is received in the normal operation mode with no image processing being performed (Yes in Step S3), the operation enters the PSR start mode with no image processing being performed on images (Step S4).

In the PSR start mode with no image processing being performed, the second to fourth switch signals are set to "0".

In this case, input image data output from the receiver 20 is output from the second multiplexer MUX2, and input image data for one frame output from the receiver 20 is written in the remote frame buffer RFB through control by the PSR control circuit 12. The operations of the third and fourth multiplexers MUX3 and MUX4 are the same as those in the normal operation mode with no image processing being performed. The operation that follows is the same as that in the normal operation mode. The same applies to subsequent operation modes.

In the PSR start mode with no image processing being performed, when image data for one frame is written in the remote frame buffer RFB whereupon the one-frame passing signal is output from the PSR control circuit 12, the operation enters the PSR mode with no image processing being performed on images (Step S4).

In the PSR mode with no image processing being performed, the fourth switch signal is set to "1".

In this case, image data read out from the remote frame buffer RFB through control by the PSR control circuit 12 is output from the fourth multiplexer MUX4.

In other words, to display an image corresponding to image data not subjected to image processing by PSR, the switch signal generating circuit 16 generates switch signals controlling switching of selected image data such that input image data is input, via the second multiplexer MUX2, to the PSR control circuit 12 to be written in the remote frame buffer RFB and subsequently, image data read out from the remote frame buffer RFB is output from the fourth multiplexer MUX4.

Next, it is detected whether the PSR Inactive signal is received (Step S5).

When the PSR Inactive signal is not received in the PSR mode with no image processing being performed (No in Step S5), the operation returns to Step S4 where the PSR mode with no image processing being performed on images is maintained.

When the PSR Inactive signal is received (Yes in Step S5), the operation enters the PSR end mode with no image processing being performed on images (Step S6).

In the PSR end mode with no image processing being performed, the second and third switch signals are set to "0", and the fourth switch signal is set to "1".

In this case, input image data output from the receiver 20 is output from the second multiplexer MUX2, and the input image data output from the receiver 20 is written in the remote frame buffer RFB through control by the PSR control circuit 12. Input image data output from the receiver 20 is output from the third multiplexer MUX3, and image data read out from the remote frame buffer RFB through control by the PSR control circuit 12 is output from the fourth multiplexer MUX4.

In the PSR end mode with no image processing being performed, phase adjustment between input image data output from the receiver 20 and image data read out from the remote frame buffer RFB is carried out through control by the PSR control circuit 12.

In the normal operation mode, the receiver 20 operates in synchronization with a pixel clock generated based on a recovery clock recovered from input image data sent from the transmitter. Meanwhile, when the operation of the transmitter is stopped in the PSR mode, the receiver 20 operates in synchronization with a pixel clock generated based on the internal clock of the receiver 20. Accordingly, the operation timing of the transmitter and that of the receiver 20 are sometimes out of synchronization in the PSR end mode. The same can be said for the PSR2 mode.

Even when the transmitter is not in operation, the receiver 20 still receives, from the transmitter, as a control signal, Virtual Blanking End (VBE) generation information representing the end timing of the first horizontal blanking period in a vertical active period of the transmitter on a frame basis, for instance.

Based on the VBE generation information, the PSR control circuit 12 generates a VBE signal used as end timing of the first horizontal blanking period in the vertical active period of the receiver 20. Subsequently, based on the VBE signal, a count value of the transmitter that represents the number of lines from the first line to a predetermined line in one frame is counted, and similarly a count value of the receiver 20 that represents the number of lines from the first line to a predetermined line in one frame is counted. Then, based on the comparison result between the count value of the transmitter and the count value of the receiver 20, the length of the vertical blanking period in the receiver 20, for example, is adjusted using the number of lines to thereby synchronize the operation timing of the transmitter and that of the receiver 20.

In this manner, phase adjustment between input image data output from the receiver 20 and image data read out from the remote frame buffer RFB is carried out. In other words, the operation timing of the transmitter and that of the receiver 20 are synchronized.

Note that the foregoing phase adjustment is merely one example. In the present invention, phase adjustment is not limited to the foregoing example and may be carried out by any of various phase adjustment methods.

Next, it is detected whether the PSR Active signal is received (Step S7).

When the PSR Active signal is received in the PSR end mode with no image processing being performed (Yes in Step S7), the operation returns to Step S4 and enters the PSR mode with no image processing being performed on images.

When the PSR Active signal is not received (No in Step S7), it is detected whether the PSR2 Active signal is received (Step S8).

When the PSR2 Active signal is received in the PSR end mode with no image processing being performed (Yes in Step S8), the operation proceeds to Step S11.

When the PSR2 Active signal is not received (No in Step S8), the operation proceeds to Step S9. When phase adjustment is completed and the PSR control circuit 12 outputs the phase adjustment completion signal (Step S9), the operation returns to Step S1 and enters the normal operation mode with no image processing being performed on images.

After phase adjustment is carried out in the PSR end mode with no image processing being performed, when the operation changes from the PSR end mode with no image processing being performed to the normal operation mode with no image processing being performed, in the next vertical blanking period, image data to be output from the fourth multiplexer MUX4 is switched from image data read out from the remote frame buffer RFB into image data output from the third multiplexer MUX3, that is, input image data output from the receiver 20.

Meanwhile, in Step S3, when the PSR Active signal is not received in the normal operation mode with no image processing being performed (No in Step S3), it is detected whether the PSR2 Active signal is received (Step S10).

When the PSR2 Active signal is not received in the normal operation mode with no image processing being performed (No in Step S10), the operation returns to Step S1 where the normal operation mode with no image processing being performed on images is maintained.

When the PSR2 Active signal is received (Yes in Step S10), the operation enters the PSR2 start mode with no image processing being performed on images (Step S11).

In the PSR2 start mode with no image processing being performed, the second to fourth switch signals are set to "0".

In this case, input image data output from the receiver 20 is output from the second multiplexer MUX2, and input image data for one frame output from the receiver 20 is written in the remote frame buffer RFB through control by the PSR control circuit 12. The operations of the third and fourth multiplexers MUX3 and MUX4 are the same as those in the normal operation mode with no image processing being performed.

In the PSR2 start mode with no image processing being performed, when image data for one frame containing input image data output from the receiver 20 is written in the remote frame buffer RFB whereupon the one-frame passing signal is output from the PSR control circuit 12, the operation enters the PSR2 mode with no image processing being performed on images (Step S11).

In the PSR2 mode with no image processing being performed, the fourth switch signal is set to "1".

The operation in this case is the same as that in the PSR mode with no image processing being performed.

Specifically, to display an image corresponding to image data not subjected to image processing by PSR2, the switch signal generating circuit 16 generates switch signals controlling switching of selected image data such that input image data is input, via the second multiplexer MUX2, to the PSR control circuit 12 to be written in the remote frame buffer RFB and subsequently, image data read out from the remote frame buffer RFB is output from the fourth multiplexer MUX4.

Next, it is detected whether the PSR2 Inactive signal is received (Step S12).

When the PSR2 Inactive signal is not received in the PSR2 mode with no image processing being performed (No in Step S12), the operation returns to Step S11 where the PSR2 mode with no image processing being performed on images is maintained.

When the PSR2 Inactive signal is received (Yes in Step S12), the operation enters the PSR2 end mode with no image processing being performed on images (Step S6).

In the PSR2 end mode with no image processing being performed, the second and third switch signals are set to "0", and the fourth switch signal is set to "1".

The operation in this case is the same as that in the PSR end mode with no image processing being performed.

Meanwhile, in Step S2, when the IPU1 Enable signal is received in the normal operation mode with no image processing being performed (Yes in Step S2), the operation enters the normal operation mode with image processing being performed on images.

In the normal operation mode with image processing being performed, the first and fourth switch signals are set to "0", and the third switch signal is set to "1", as shown in Table 1.

Figure 4:
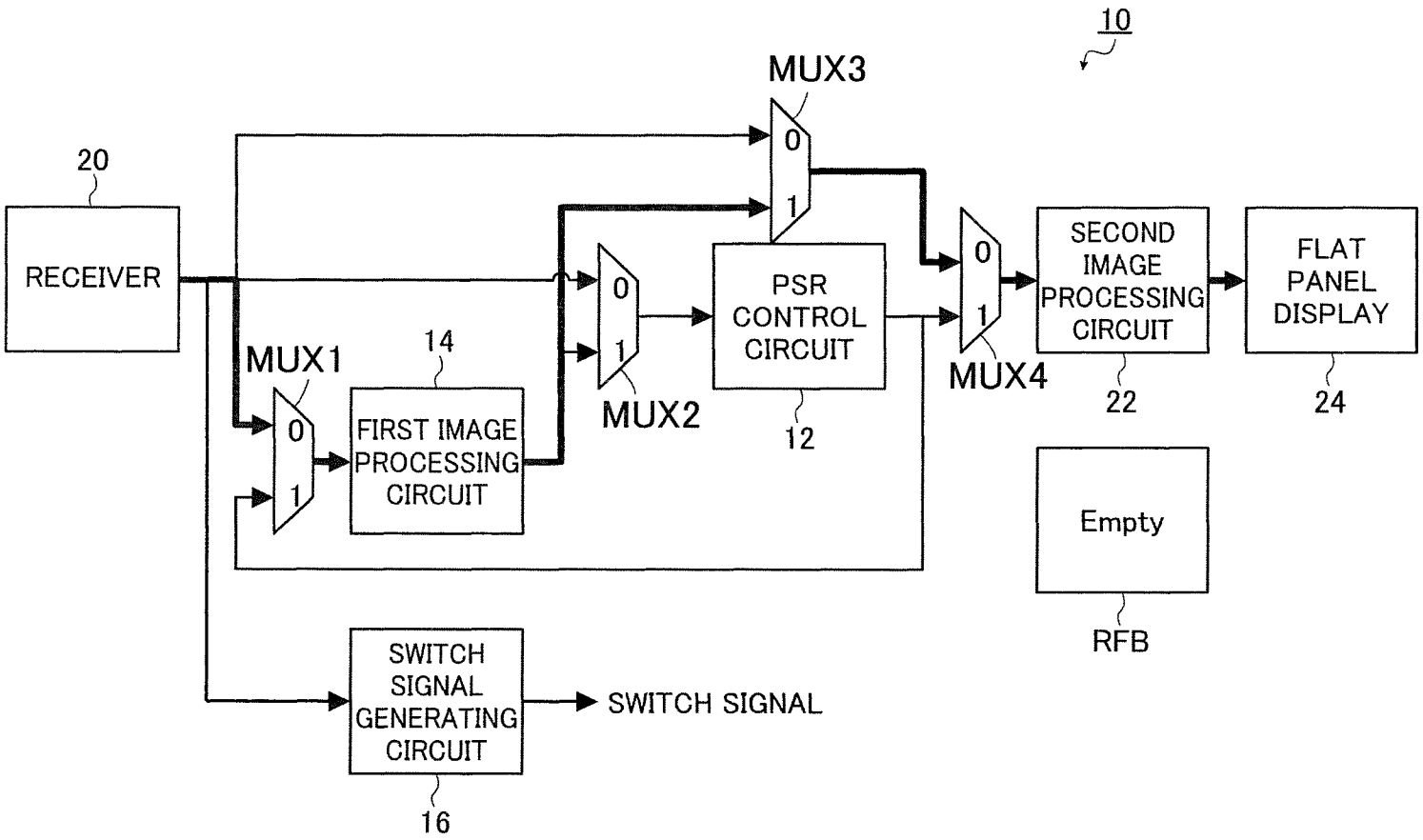
FIG. 4 is a block diagram showing paths of image data in a normal operation mode with image processing being performed on images.

In this case, as indicated by thick lines in FIG. 4, input image data output from the receiver 20 is output from the first multiplexer MUX1, and the input image data output from the receiver 20 is subjected to image processing in the first image processing circuit 14. The image-processed image data output from the first image processing circuit 14 is output from the third multiplexer MUX3, and the image data output from the third multiplexer MUX3, that is, the image-processed image data output from the first image processing circuit 14 is output from the fourth multiplexer MUX4. At this time, the remote frame buffer RFB is empty.

In other words, to display an image corresponding to image-processed image data by the normal operation, the switch signal generating circuit 16 generates switch signals controlling switching of selected image data such that input image data is input, via the first multiplexer MUX1, to the first image processing circuit 14 to be subjected to image processing and that image-processed image data is output from the fourth multiplexer MUX4 via the third multiplexer MUX3.

Next, it is detected whether the PSR Active signal is received (Step S13).

When the PSR Active signal is received in the normal operation mode with image processing being performed (Yes in Step S13), the operation enters the PSR start mode with image processing being performed on images (Step S14).

In the PSR start mode with image processing being performed, the first and fourth switch signals are set to "0", and the second and third switch signals are set to "1".

Figure 5:
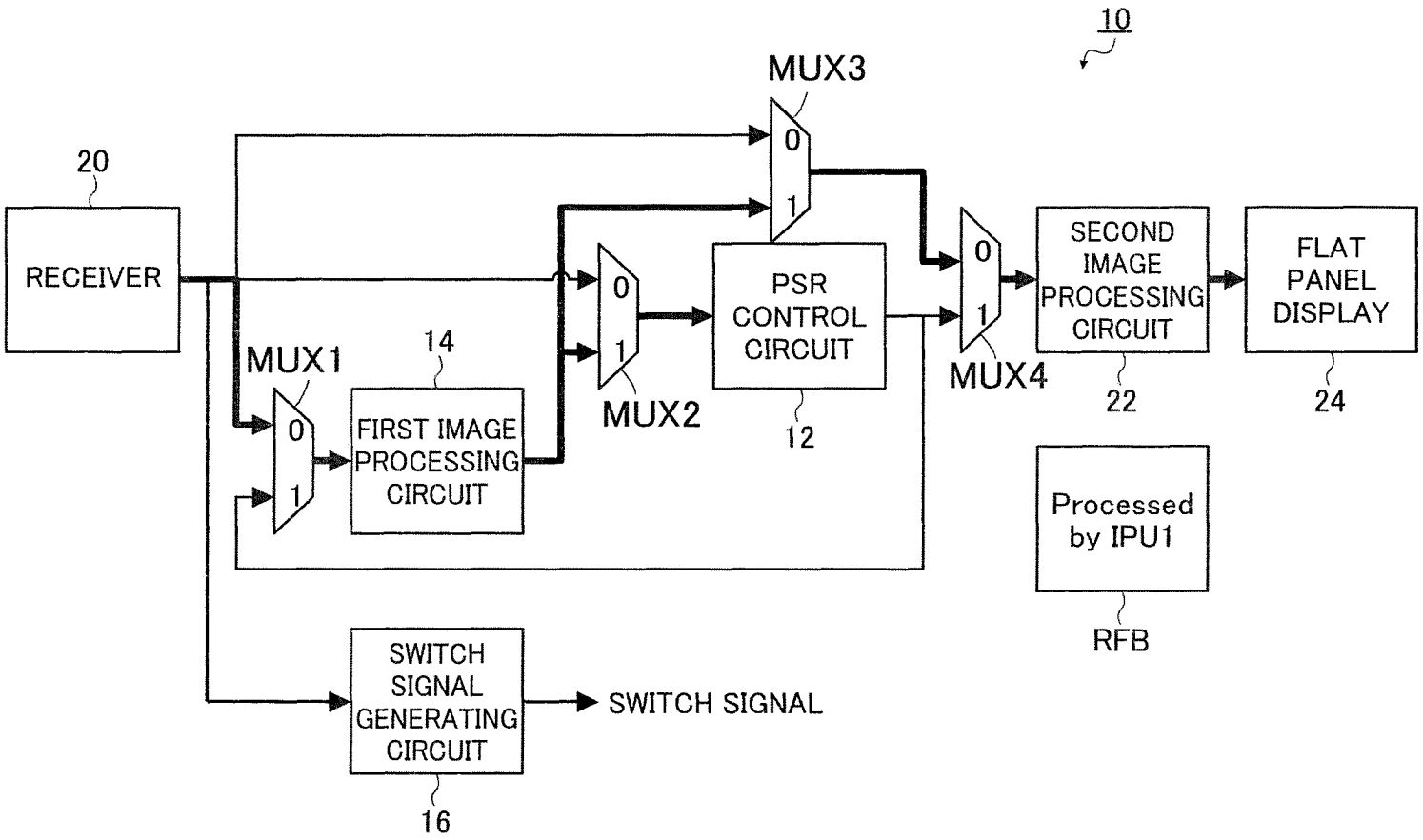
FIG. 5 is a block diagram showing paths of image data in a PSR start mode with image processing being performed on images.

In this case, as indicated by thick lines in FIG. 5, input image data output from the receiver 20 is output from the first multiplexer MUX1, and the input image data output from the receiver 20 is subjected to image processing in the first image processing circuit 14. The image-processed image data output from the first image processing circuit 14 is output from the second multiplexer MUX2, and the image-processed image data (Processed by IPU1) is written in the remote frame buffer RFB through control by the PSR control circuit 12. Image-processed image data output from the first image processing circuit 14 is output from the third multiplexer MUX3, and the image data output from the third multiplexer MUX3, that is, the image-processed image data output from the first image processing circuit 14 is output from the fourth multiplexer MUX4.

In the PSR start mode with image processing being performed, when image-processed image data for one frame is written in the remote frame buffer RFB whereupon the one-frame passing signal is output from the PSR control circuit 12, the operation enters the PSR mode with image processing being performed on images (Step S14).

In the PSR mode with image processing being performed, the fourth switch signal is set to "1".

Figure 6:
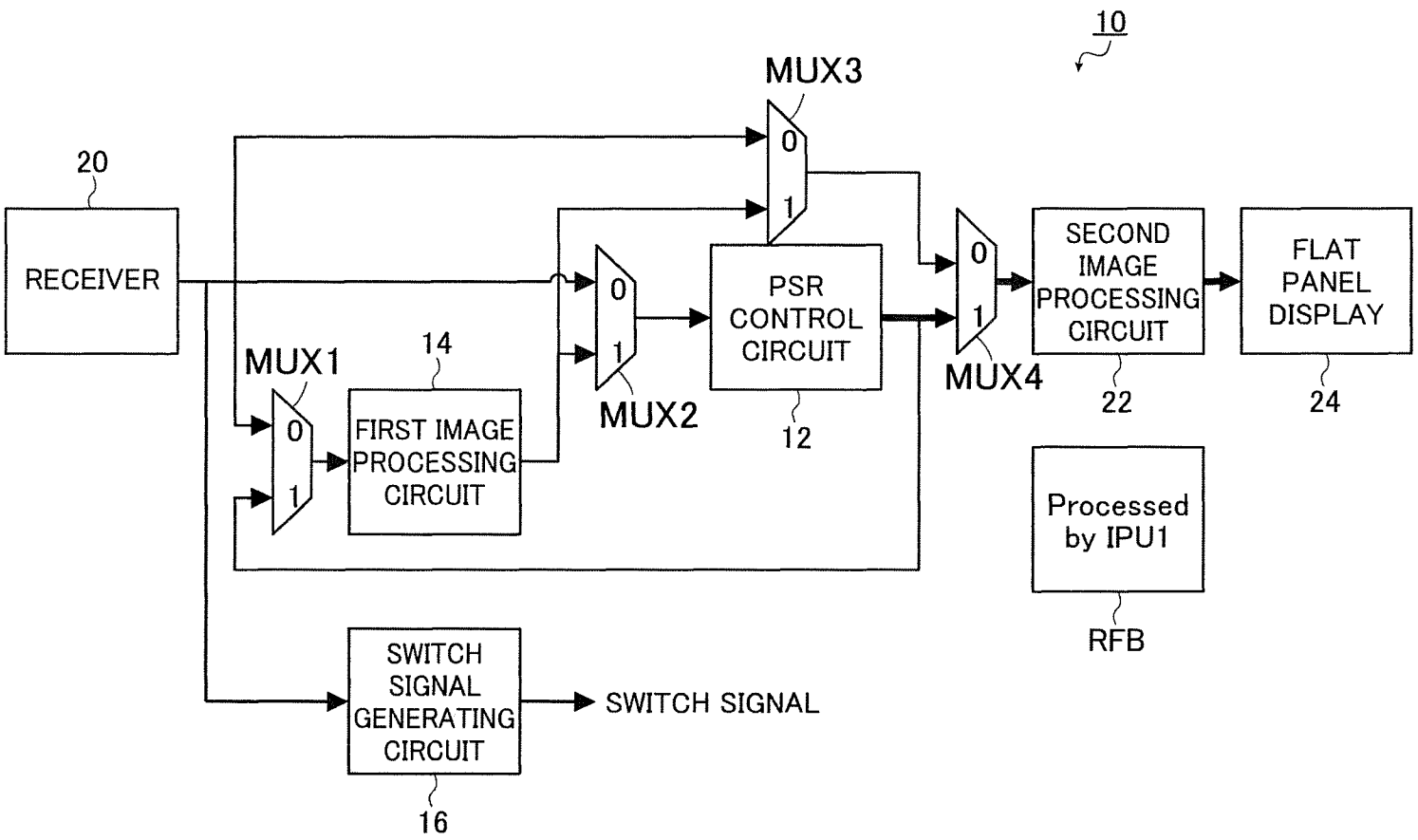
FIG. 6 is a block diagram showing paths of image data in a PSR mode with image processing being performed on images.

In this case, as indicated by thick lines in FIG. 6, image-processed image data (Processed by IPU1) read out from the remote frame buffer RFB through control by the PSR control circuit 12 is output from the fourth multiplexer MUX4.

In other words, to display a still image corresponding to image-processed image data by PSR, the switch signal generating circuit 16 generates switch signals controlling switching of selected image data such that input image data is input, via the first multiplexer MUX1, to the first image processing circuit 14 to be subjected to image processing, that image-processed image data is input, via the second multiplexer MUX2, to the PSR control circuit 12 to be written in the remote frame buffer RFB through control by the PSR control circuit 12, and that image-processed image data read out from the remote frame buffer RFB is output from the fourth multiplexer MUX4 or image-processed image data is output from the fourth multiplexer MUX4 via the third multiplexer MUX3.

In the image processing device 10, to display a still image corresponding to image-processed image data by PSR, input image data output from the receiver 20 is subjected to image processing in the first image processing circuit 14, the image-processed image data is written in the remote frame buffer RFB through control by the PSR control circuit 12, and the image-processed image data read out from the remote frame buffer RFB is output from the fourth multiplexer MUX4.

Thus, when a still image subjected to image processing is displayed by PSR, the first image processing circuit 14 can be stopped, and power consumption of the first image processing circuit 14 can be reduced accordingly.

Next, it is detected whether the PSR Inactive signal is received (Step S15).

When the PSR Inactive signal is not received in the PSR mode with image processing being performed (No in Step S15), the operation returns to Step S14 where the PSR mode with image processing being performed on images is maintained.

When the PSR Inactive signal is received (Yes in Step S15), the operation enters the PSR end mode with image processing being performed on images (Step S16).

In the PSR end mode with image processing being performed, the first switch signal is set to "0", and the second to fourth switch signals are set to "1".

Figure 7:
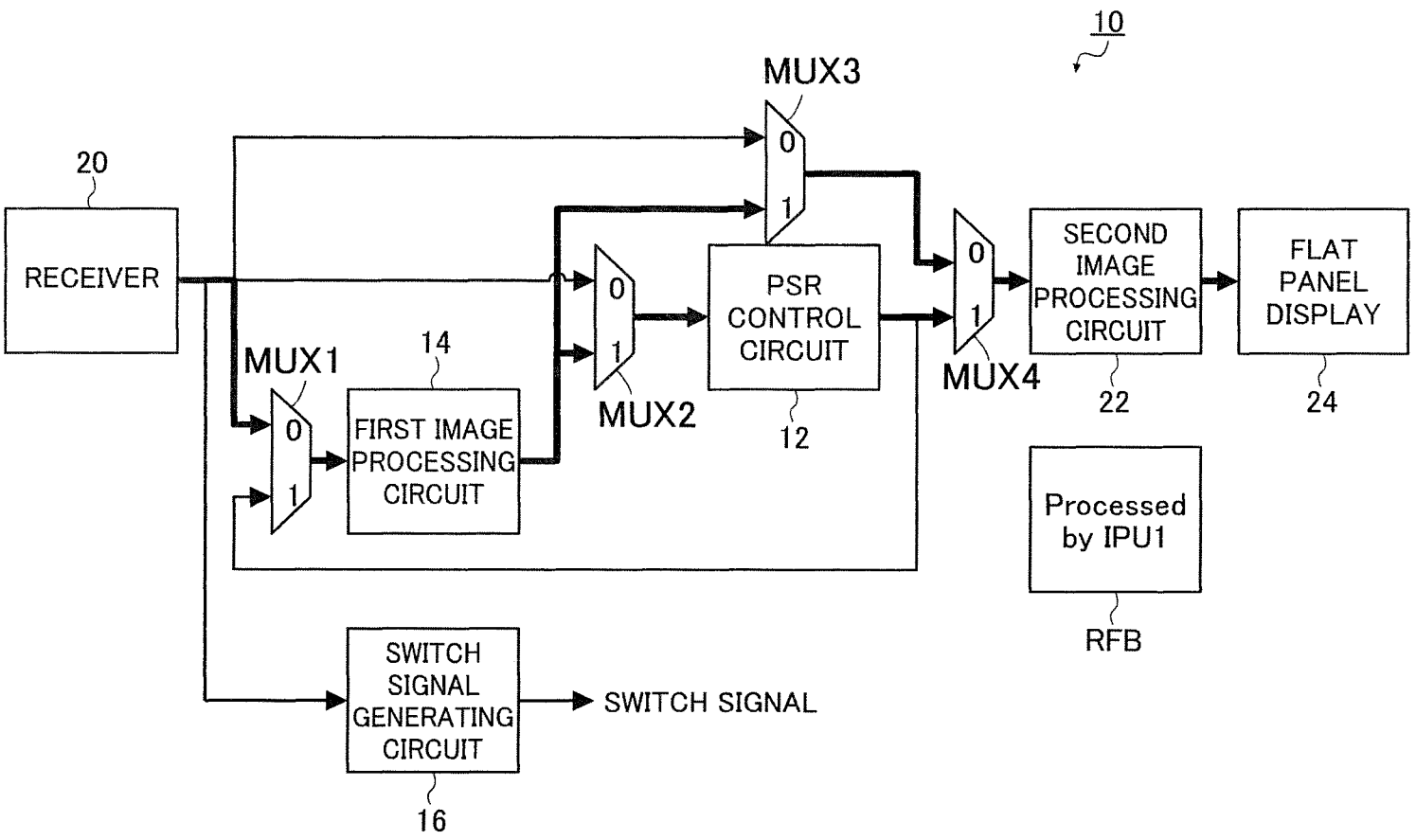
FIG. 7 is a block diagram showing paths of image data in a PSR end mode with image processing being performed on images.

In this case, as indicated by thick lines in FIG. 7, input image data output from the receiver 20 is output from the first multiplexer MUX1, and the input image data output from the receiver 20 is subjected to image processing in the first image processing circuit 14. The image-processed image data output from the first image processing circuit 14 is output from the second multiplexer MUX2, and the image-processed image data (Processed by IPU1) output from the first image processing circuit 14 is written in the remote frame buffer RFB through control by the PSR control circuit 12. Image-processed image data output from the first image processing circuit 14 is output from the third multiplexer MUX3, and the image-processed image data read out from the remote frame buffer RFB through control by the PSR control circuit 12 is output from the fourth multiplexer MUX4.

In the PSR end mode with image processing being performed, phase adjustment between input image data output from the receiver 20 and image data read out from the remote frame buffer RFB is carried out through control by the PSR control circuit 12.

Next, it is detected whether the PSR Active signal is received (Step S17).

When the PSR Active signal is received in the PSR end mode with image processing being performed (Yes in Step S17), the operation returns to Step S14 and enters the PSR mode with image processing being performed on images.

When the PSR Active signal is not received (No in Step S17), it is detected whether the PSR2 Active signal is received (Step S18).

When the PSR2 Active signal is received in the PSR end mode with image processing being performed (Yes in Step S18), the operation proceeds to Step S21.

When the PSR2 Active signal is not received (No in Step S18), the operation proceeds to Step S19. When phase adjustment is completed and the PSR control circuit 12 outputs the phase adjustment completion signal (Step S19), the operation enters the normal operation mode with image processing being performed on images (Step S27).

After phase adjustment is carried out in the PSR end mode with image processing being performed, when the operation changes from the PSR end mode with image processing being performed to the normal operation mode with image processing being performed, in the next vertical blanking period, image data to be output from the fourth multiplexer MUX4 is switched from image data read out from the remote frame buffer RFB through control by the PSR control circuit 12 into image data output from the third multiplexer MUX3, that is, image-processed image data output from the first image processing circuit 14, as indicated by thick lines in FIGS. 4 and 7.

Meanwhile, in Step S13, when the PSR Active signal is not received in the normal operation mode with image processing being performed (No in Step S13), it is detected whether the PSR2 Active signal is received (Step S20).

When the PSR2 Active signal is not received in the normal operation mode with image processing being performed (No in Step S20), the operation proceeds to Step S27.

When the PSR2 Active signal is received (Yes in Step S20), the operation enters the PSR2 start mode with image processing being performed on images (Step S21).

In the PSR2 start mode with image processing being performed, the first, second and fourth switch signals are set to "0", and the third switch signal is set to "1".

Figure 8:
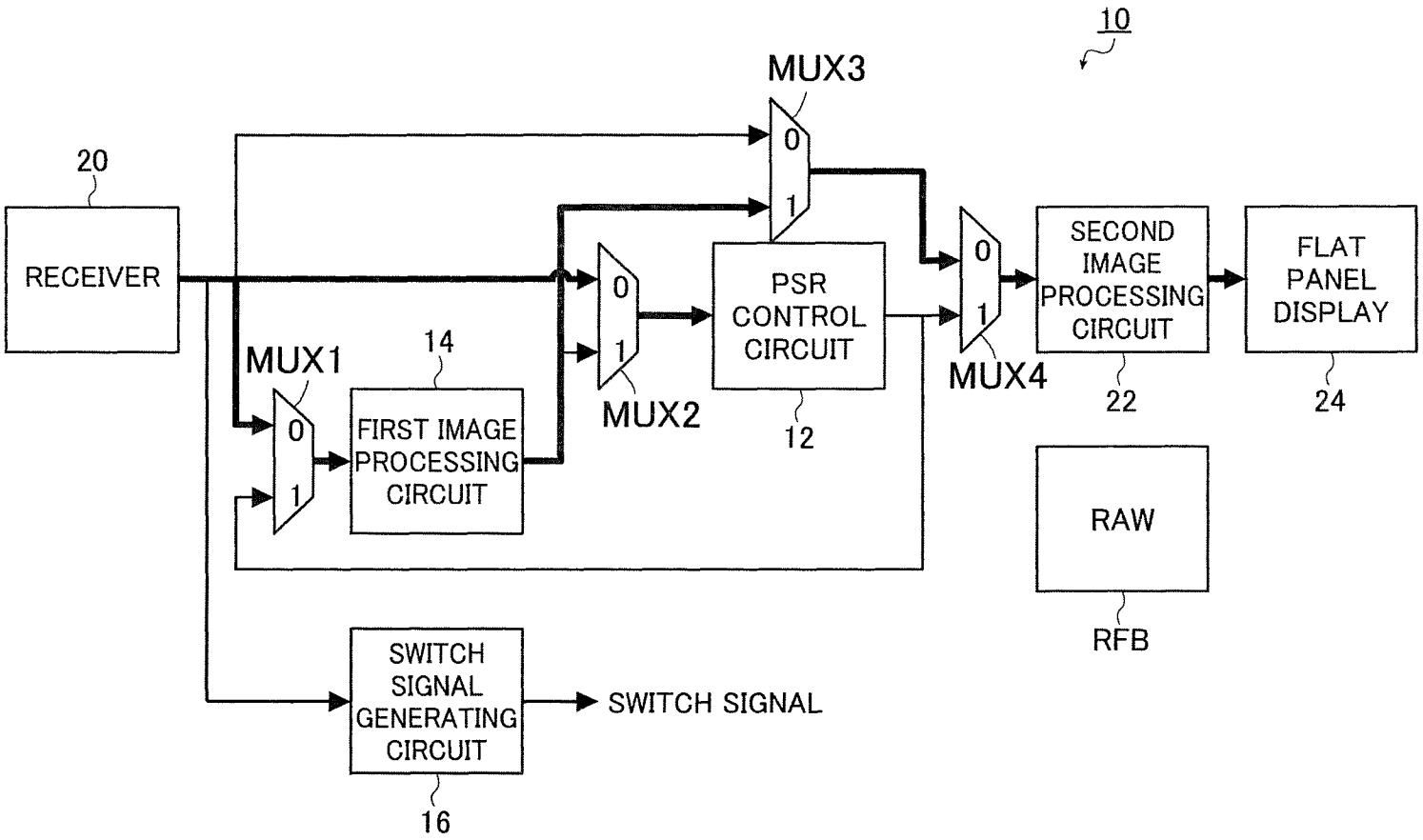
FIG. 8 is a block diagram showing paths of image data in a PSR2 start mode with image processing being performed on images.

In this case, as indicated by thick lines in FIG. 8, input image data output from the receiver 20 is output from the first multiplexer MUX1, and the input image data output from the receiver 20 is subjected to image processing in the first image processing circuit 14. Input image data output from the receiver 20 is output from the second multiplexer MUX2, and the input image data (RAW) output from the receiver 20 is written in the remote frame buffer RFB through control by the PSR control circuit 12. The image-processed image data output from the first image processing circuit 14 is output from the third multiplexer MUX3, and the image data output from the third multiplexer MUX3, that is, the image-processed image data output from the first image processing circuit 14 is output from the fourth multiplexer MUX4.

In the PSR2 start mode with image processing being performed, when image data for one frame containing input image data output from the receiver 20 is written in the remote frame buffer RFB by the PSR control circuit 12 whereupon the one-frame passing signal is output from the PSR control circuit 12, the operation enters the PSR2 mode with image processing being performed on images (Step S21).

In the PSR2 mode with image processing being performed, the first and third switch signals are set to "1", and the fourth switch signal is set to "0".

Figure 9:
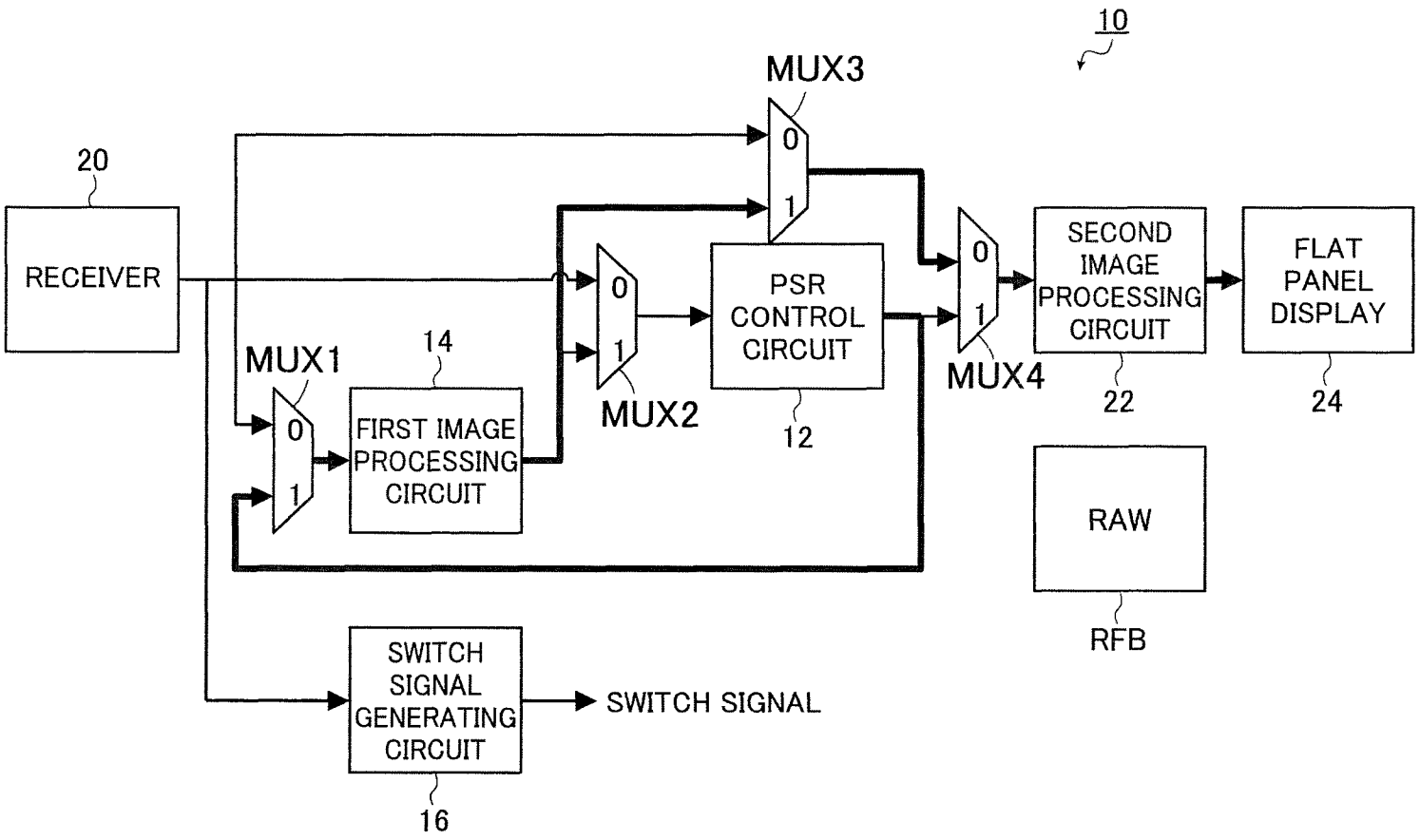
FIG. 9 is a block diagram showing paths of image data in a PSR2 mode with image processing being performed on images.

In this case, as indicated by thick lines in FIG. 9, image data (RAW) read out from the remote frame buffer RFB through control by the PSR control circuit 12 is output from the first multiplexer MUX1, and the image data read out from the remote frame buffer RFB is subjected to image processing in the first image processing circuit 14. The image-processed image data output from the first image processing circuit 14 is output from the third multiplexer MUX3, and the image data output from the third multiplexer MUX3, that is, the image-processed image data output from the first image processing circuit 14 is output from the fourth multiplexer MUX4.

In other words, to display a still image corresponding to image-processed image data by PSR2, the switch signal generating circuit 16 generates switch signals controlling switching of selected image data such that input image data is input, via the second multiplexer MUX2, to the PSR control circuit 12 to be written in the remote frame buffer RFB, that input image data is input, via the first multiplexer MUX1, to the first image processing circuit 14 to be subjected to image processing or image data read out from the remote frame buffer RFB is input, via the first multiplexer MUX1, to the first image processing circuit 14 to be subjected to image processing, and that image-processed image data is output from the fourth multiplexer MUX4 via the third multiplexer MUX3.

Next, it is detected whether the PSR2 Inactive signal is received (Step S22).

When the PSR2 Inactive signal is not received in the PSR2 mode with image processing being performed (No in Step S22), the operation returns to Step S21 where the PSR2 mode with image processing being performed on images is maintained.

When the PSR2 Inactive signal is received (Yes in Step S22), the operation enters the PSR2 end mode with image processing being performed on images (Step S23).

In the PSR2 end mode with image processing being performed, the second and fourth switch signals are set to "0", and the first and third switch signals are set to "1".

Figure 10:
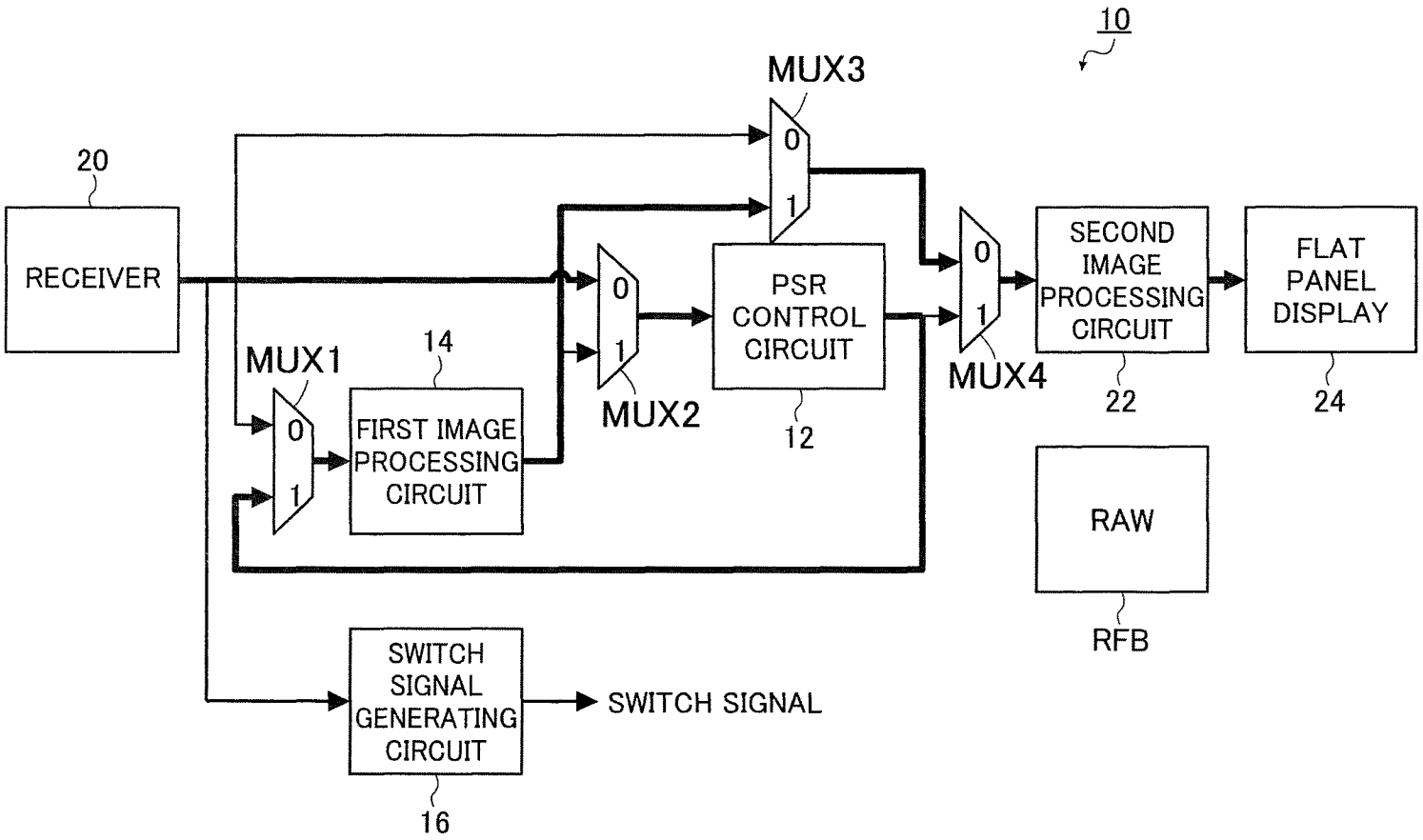
FIG. 10 is a block diagram showing paths of image data in a PSR2 end mode with image processing being performed on images.

In this case, as indicated by thick lines in FIG. 10, image data (RAW) read out from the remote frame buffer RFB through control by the PSR control circuit 12 is output from the first multiplexer MUX1, and the image data read out from the remote frame buffer RFB is subjected to image processing in the first image processing circuit 14. Input image data output from the receiver 20 is output from the second multiplexer MUX2, and the input image data (RAW) output from the receiver 20 is written in the remote frame buffer RFB through control by the PSR control circuit 12. In writing image data to the remote frame buffer RFB, new image data is sequentially overwritten to a region from which image data has been read out. Image-processed image data output from the first image processing circuit 14 is output from the third multiplexer MUX3, and the image data output from the third multiplexer MUX3, that is, the image-processed image data output from the first image processing circuit 14 is output from the fourth multiplexer MUX4.

In the PSR2 end mode with image processing being performed, phase adjustment between input image data output from the receiver 20 and image data read out from the remote frame buffer RFB is carried out through control by the PSR control circuit 12.

Next, it is detected whether the PSR Active signal is received (Step S24).

When the PSR Active signal is received in the PSR2 end mode with image processing being performed (Yes in Step S24), the operation returns to Step S21 and enters not the PSR mode with image processing being performed but the PSR2 mode with image processing being performed on images.

To shift the operation from the PSR2 end mode with image processing being performed to the PSR mode with image processing being performed, input image data output from the receiver 20 needs to be output from the first multiplexer MUX1 and input to the first image processing circuit 14.

In the PSR2 end mode with image processing being performed, however, image data (RAW) read out from the remote frame buffer RFB is output from the first multiplexer MUX1 and input to the first image processing circuit 14.

Therefore, in the image processing device 10 in this embodiment, the operation cannot shift from the PSR2 end mode with image processing being performed to the PSR mode with image processing being performed, and thus shifts to the PSR2 mode with image processing being performed.

When the PSR Active signal is not received (No in Step S24), it is detected whether the PSR2 Active signal is received (Step S25).

When the PSR2 Active signal is received in the PSR2 end mode with image processing being performed (Yes in Step S25), the operation returns to Step S21 and enters the PSR2 mode with image processing being performed on images.

When the PSR2 Active signal is not received (No in Step S25), the operation proceeds to Step S26. When phase adjustment is completed and the PSR control circuit 12 outputs the phase adjustment completion signal (Step S26), the operation enters the normal operation mode with image processing being performed on images (Step S27).

After phase adjustment is carried out in the PSR2 end mode with image processing being performed, when the operation changes from the PSR2 end mode with image processing being performed to the normal operation mode with image processing being performed, in the next vertical blanking period, image data to be output from the fourth multiplexer MUX4 is switched from image data read out from the remote frame buffer RFB through control by the PSR control circuit 12 and subjected to image processing in the first image processing circuit 14 into image data output from the receiver 20 and subjected to image processing in the first image processing circuit 14, as indicated by thick lines in FIGS. 4 and 10.

Next, it is detected whether the IPU1 Disable signal is received (Step S28).

When the IPU1 Disable signal is not received in the normal operation mode with image processing being performed (No in Step S28), the operation proceeds to Step S13.

When the IPU1 Disable signal is received in the normal operation mode with image processing being performed (Yes in Step S28), the operation proceeds to Step S1 and enters the normal operation mode with no image processing being performed on images. The foregoing steps are repeated in the subsequent operation.

Meanwhile, in the PSR2 mode with image processing being performed, the first image processing circuit 14 is to keep operating. While there is no problem in performing image processing on image data, power consumption associated with the continuous operation of the first image processing circuit 14 cannot be reduced.

To deal with it, a remote frame buffer RFB having a first and second frame regions storing image data for two frames is used. With this configuration, the first image processing circuit 14 can be stopped even in the PSR2 mode where image processing is performed on a partial image.

For instance, in the PSR2 mode, image-processed image data output from the first image processing circuit 14 is output, and simultaneously, the image-processed image data is written in the first frame region of the remote frame buffer RFB. After the image-processed image data is written in the first frame region of the remote frame buffer RFB, the image data written in the first frame region of the remote frame buffer RFB can be output as long as the image is a still image.

In the PSR2 mode with image processing being performed, the first to third switch signals are set to "1", and the fourth switch signal is set to "0", for instance.

Figure 11:
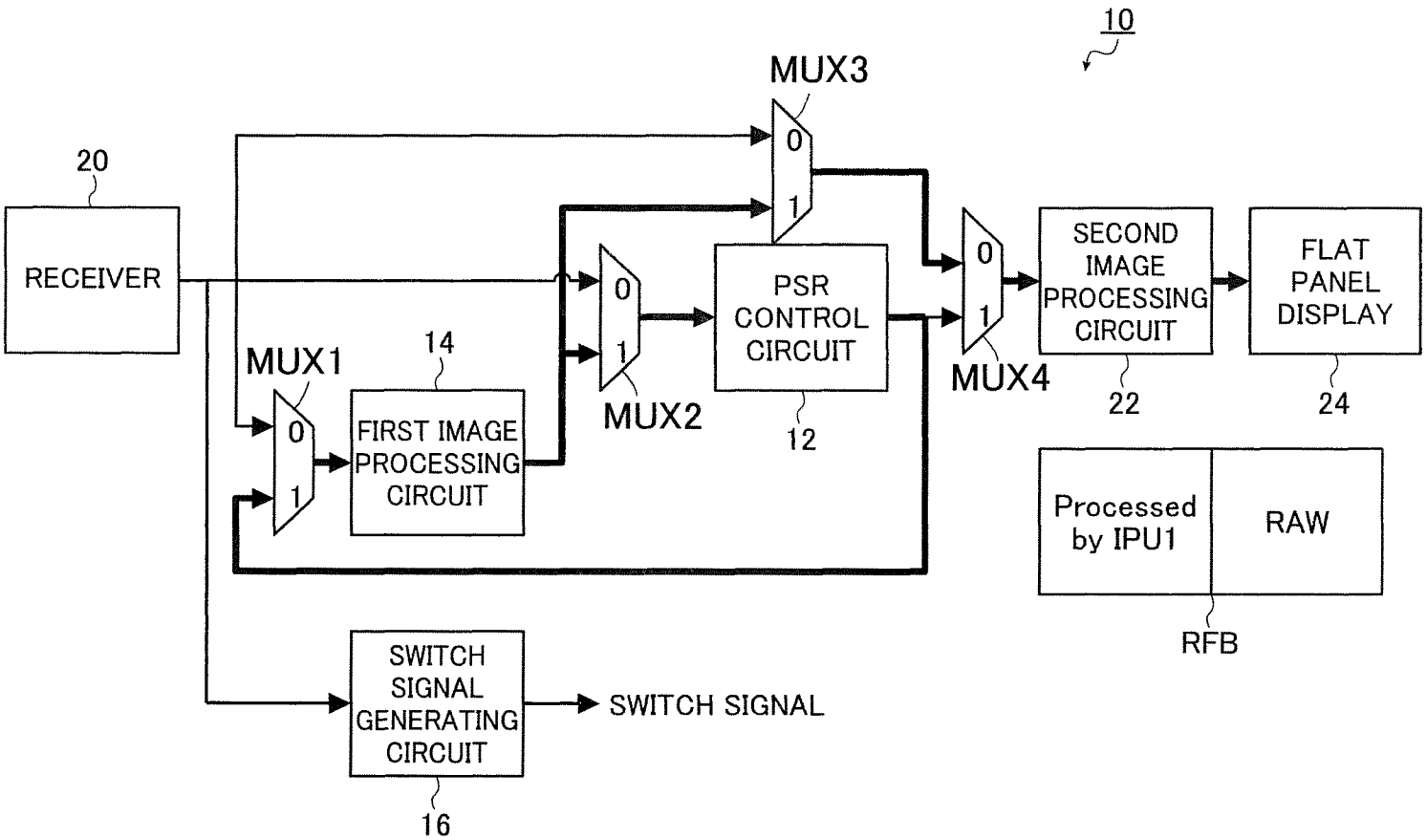
FIG. 11 is another block diagram showing paths of image data in the PSR2 mode with image processing being performed on images.

In this case, as indicated by thick lines in FIG. 11, image data (RAW) read out from the second frame region of the remote frame buffer RFB (the right region of the remote frame buffer RFB in FIG. 11) through control by the PSR control circuit 12 is output from the first multiplexer MUX1, and the image data read out from the second frame region of the remote frame buffer RFB is subjected to image processing in the first image processing circuit 14. The image-processed image data output from the first image processing circuit 14 is output from the second multiplexer MUX2, and input image data (Processed by IPU1) for one frame output from the receiver 20 is written in the first frame region of the remote frame buffer RFB (the left region of the remote frame buffer RFB in FIG. 11) through control by the PSR control circuit 12. The image-processed image data output from the first image processing circuit 14 is output from the third multiplexer MUX3, and the image data output from the third multiplexer MUX3, that is, the image-processed image data output from the first image processing circuit 14 is output from the fourth multiplexer MUX4.

Next, when image data for one frame for use in the PSR2 mode is written in the first frame region of the remote frame buffer RFB whereupon the one-frame passing signal is output from the PSR control circuit 12, the fourth switch signal is changed from "0" to "1".

Figure 12:
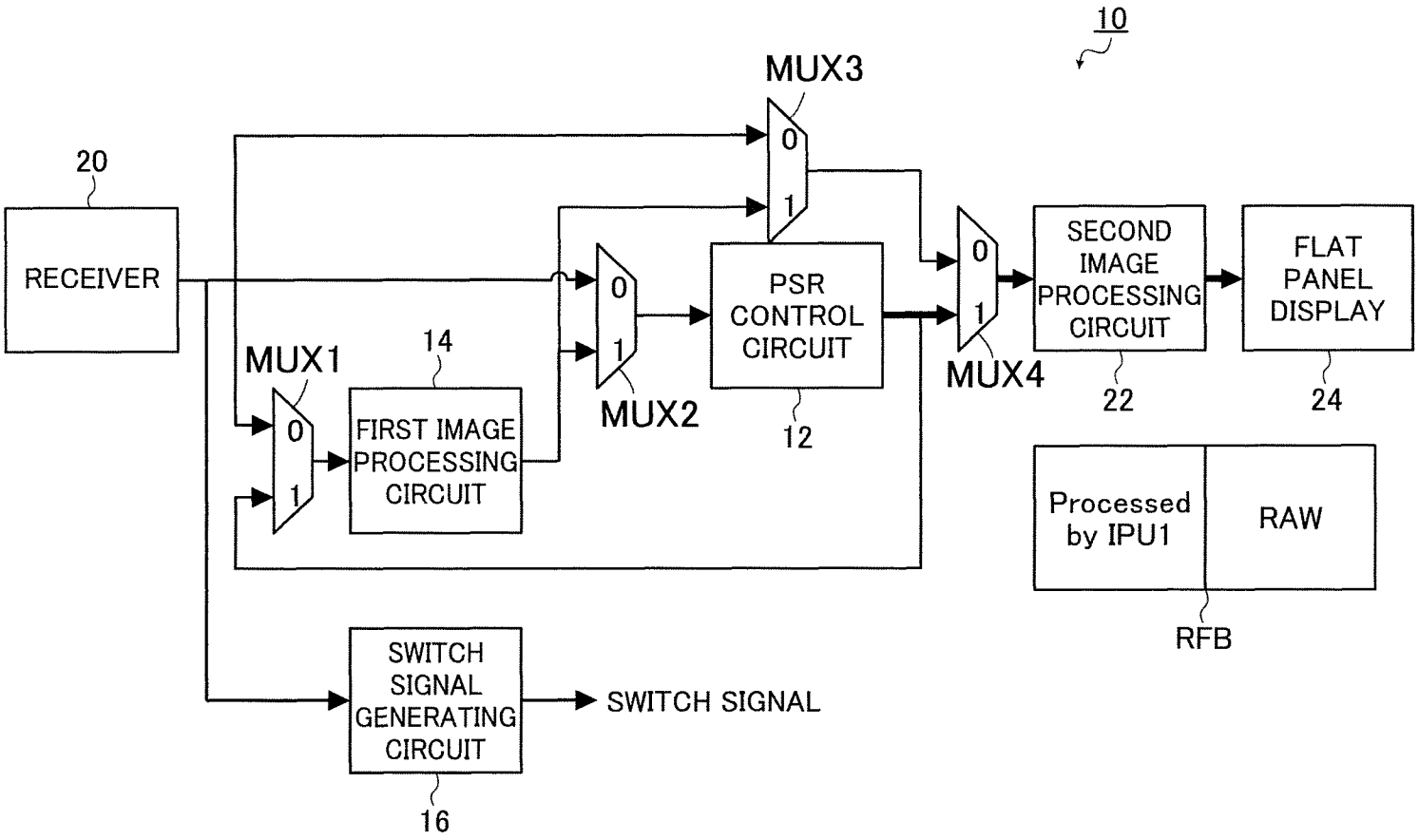
FIG. 12 is another block diagram showing paths of image data in the PSR2 mode with image processing being performed on images.

In this case, as indicated by thick lines in FIG. 12, image data (Processed by IPU1) read out from the first frame region of the remote frame buffer RFB through control by the PSR control circuit 12 is output from the fourth multiplexer MUX4.

In other words, to display a still image corresponding to image-processed image data by PSR2, the switch signal generating circuit 16 generates switch signals controlling switching of selected image data such that image data read out from the second frame region of the remote frame buffer RFB is input, via the first multiplexer MUX1, to the first image processing circuit 14 to be subjected to image processing, and that image-processed image data is input, via the second multiplexer MUX2, to the PSR control circuit 12 to be written in the first frame region of the remote frame buffer RFB and then the image-processed image data read out from the first frame region of the remote frame buffer RFB is output from the fourth multiplexer MUX4 or the image-processed image data is output from the fourth multiplexer MUX4 via the third multiplexer MUX3.

In the image processing device 10, to display a still image corresponding to image-processed image data by PSR2, image data read out from the second frame region of the remote frame buffer RFB through control by the PSR control circuit 12 is subjected to image processing in the first image processing circuit 14, the image-processed image data is written in the first frame region of the remote frame buffer RFB through control by the PSR control circuit 12, and then the image-processed image data read out from the first frame region of the remote frame buffer RFB is output from the fourth multiplexer MUX4.

Thus, when a still image whose partial region is subjected to image processing is displayed by PSR2, the first image processing circuit 14 can be stopped, and power consumption of the first image processing circuit 14 can be reduced accordingly.

When an image used in the PSR2 mode is partially updated, new image data is written in the second frame region of the remote frame buffer RFB. Subsequently, the first image processing circuit 14 is again activated to subject the new image data to image processing therein, and the new image-processed image data is output while being written in the first frame region of the remote frame buffer RFB. After this, image data read out from the first frame region of the remote frame buffer RFB can be output.

For instance, when new input image data for updating part of an image used in the PSR2 mode is received by the receiver 20, the first and third switch signals are set to "1", and the second and fourth switch signals are set to "0".

Figure 13:
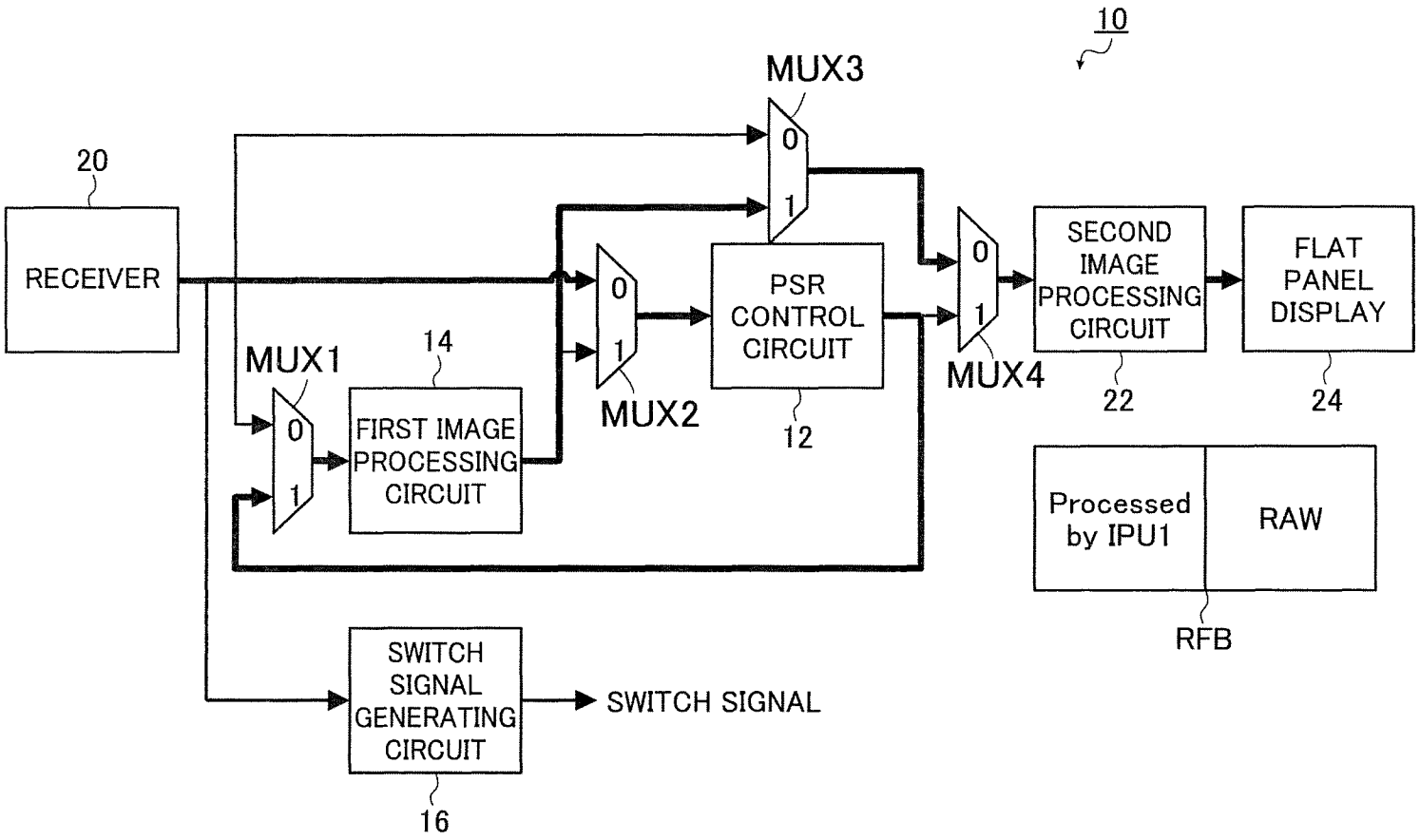
FIG. 13 is a block diagram showing paths of image data when new input image data for updating part of an image used in the PSR2 mode is received in the PSR2 mode with image processing being performed on images.

In this case, as indicated by thick lines in FIG. 13, first, new input image data output from the receiver 20 is output from the second multiplexer MUX2, and the new input image data (RAW) output from the receiver 20 is written in the second frame region of the remote frame buffer RFB through control by the PSR control circuit 12. Subsequently, new image data (RAW) read out from the first frame region of the remote frame buffer RFB through control by the PSR control circuit 12 is output from the first multiplexer MUX1, and the new image data read out from the first frame region of the remote frame buffer RFB is subjected to image processing in the first image processing circuit 14. The new image-processed image data output from the first image processing circuit 14 is output from the third multiplexer MUX3, and the image data output from the third multiplexer MUX3, that is, the new image-processed image data output from the first image processing circuit 14 is output from the fourth multiplexer MUX4. Thereafter, the above-described operation after the PSR2 mode with image processing being performed is repeated.

While the image processing device of the invention is described by way of the specific example shown in FIG. 1, the invention is not limited thereto, and circuits having different configurations may be used as long as they can achieve equivalent functions.

While the invention is described above in detail, the invention is not limited to the above embodiment, and various improvements and modifications may be made without departing from the spirit and scope of the invention.

What is claimed is:

1. An image processing device that causes an image corresponding to input image data to be displayed on an image display device by using a panel self-refresh function including panel self-refresh (PSR) and panel self-refresh 2 (PSR2), the image processing device comprising:

a panel self-refresh control circuit configured to control the panel self-refresh function;

a first image processing circuit configured to perform, on selected image data, image processing applied to an image corresponding to the selected image data;

a switch signal generating circuit configured to generate a switch signal controlling switching of image data;

a first switch circuit configured to, in response to the switch signal, switch between the input image data and image data read out from a frame buffer through control by the panel self-refresh control circuit so as to output one of the input image data and the image data read out;

a second switch circuit and a third switch circuit each configured to, in response to the switch signal, switch between the input image data and the image data having undergone the image processing so as to output one of the input image data and the image data having undergone the image processing; and a fourth switch circuit configured to, in response to the switch signal, switch between image data output from the third switch circuit and the image data read out from the frame buffer so as to output one of the image data output from the third switch circuit and the image data read out, wherein, to display, by the panel self-refresh, a still image corresponding to the image data having undergone the image processing, the switch signal generating circuit generates the switch signal controlling switching of the selected image data such that the input image data is input, via the first switch circuit, to the first image processing circuit to be subjected to the image processing, that the image data having undergone the image processing is input, via the second switch circuit, to the panel self-refresh control circuit to be written in the frame buffer through control by the panel self-refresh control circuit, and that the image data having undergone the image processing as read out from the frame buffer is output from the fourth switch circuit or the image data having undergone the image processing is output from the fourth switch circuit via the third switch circuit.

2. The image processing device according to claim 1, wherein, to display, by the panel self-refresh 2, a still image corresponding to the image data having undergone the image processing, the switch signal generating circuit generates the switch signal controlling switching of the selected image data such that the input image data is input, via the second switch circuit, to the panel self-refresh control circuit to be written in the frame buffer, that the input image data is input, via the first switch circuit, to the first image processing circuit to be subjected to the image processing or the image data read out from the frame buffer is input, via the first switch circuit, to the first image processing circuit to be subjected to the image processing, and that the image data having undergone the image processing is output from the fourth switch circuit via the third switch circuit.

3. The image processing device according to claim 1, wherein the frame buffer has a first frame region and a second frame region that store image data for two frames, and wherein, to display, by the panel self-refresh 2, a still image corresponding to the image data having undergone the image processing, the switch signal generating circuit generates the switch signal controlling switching of the selected image data such that image data read out from the second frame region of the frame buffer is input, via the first switch circuit, to the first image processing circuit to be subjected to the image processing, and that the image data having undergone the image processing is input, via the second switch circuit, to the panel self-refresh control circuit to be written in the first frame region of the frame buffer, whereafter the image data having undergone the image processing as read out from the first frame region of the frame buffer is output from the fourth switch circuit or the image data having undergone the image processing is output from the fourth switch circuit via the third switch circuit.

4. The image processing device according to claim 1, wherein, to display, by normal operation, an image corresponding to the image data having undergone the image processing, the switch signal generating circuit generates the switch signal controlling switching of the selected image data such that the input image data is input, via the first switch circuit, to the first image processing circuit to be subjected to the image processing and that the image data having undergone the image processing is output from the fourth switch circuit via the third switch circuit.

5. The image processing device according to claim 1, wherein, to display, by normal operation, an image corresponding to image data not subjected to the image processing, the switch signal generating circuit generates the switch signal controlling switching of the selected image data such that the input image data is output from the fourth switch circuit via the third switch circuit without any change.

6. The image processing device according to claim 1, wherein, to display, by the panel self-refresh or the panel self-refresh 2, an image corresponding to image data not subjected to the image processing, the switch signal generating circuit generates the switch signal controlling switching of the selected image data such that the input image data is input, via the second switch circuit, to the panel self-refresh control circuit to be written in the frame buffer, whereafter the image data read out from the frame buffer is output from the fourth switch circuit.

7. The image processing device according to claim 1, wherein the switch signal generating circuit generates, as the switch signal, a first switch signal that controls switching of image data in the first switch circuit such that the input image data is output in a normal operation mode where an image corresponding to the input image data is displayed by normal operation, a panel self-refresh start mode where the input image data is written in the frame buffer before the panel self-refresh starts, a panel self-refresh end mode where phase adjustment between the input image data and the image data read out from the frame buffer is carried out before the panel self-refresh ends, and a panel self-refresh 2 start mode where the input image data is written in the frame buffer before the panel self-refresh 2 starts, and the image data read out from the frame buffer is output in a panel self-refresh 2 mode where a still image is displayed by the panel self-refresh 2, and a panel self-refresh 2 end mode where phase adjustment between the input image data and the image data read out from the frame buffer is carried out before the panel self-refresh 2 ends, when the image processing is performed, a second switch signal that controls switching of image data in the second switch circuit such that the input image data is output in the panel self-refresh start mode, the panel self-refresh end mode, the panel self-refresh 2 start mode and the panel self-refresh 2 end mode when the image processing is not performed, and that the input image data is output in the panel self-refresh 2 start mode and the panel self-refresh 2 end mode, and the image data having undergone the image processing is output in the panel self-refresh start mode and the panel self-refresh end mode, when the image processing is performed, a third switch signal that controls switching of image data in the third switch circuit such that the input image data is output in the normal operation mode, the panel self-refresh start mode, the panel self-refresh end mode, the panel self-refresh 2 start mode and the panel self-refresh 2 end mode when the image processing is not performed, and that the image data having undergone the image processing is output in the normal operation mode, the panel self-refresh start mode, the panel self-refresh end mode, the panel self-refresh 2 start mode, the panel self-refresh 2 mode and the panel self-refresh 2 end mode when the image processing is performed, and a fourth switch signal that controls switching of image data in the fourth switch circuit such that image data output from the third switch circuit is output in the normal operation mode, the panel self-refresh start mode and the panel self-refresh 2 start mode when the image processing is not performed and in the normal operation mode, the panel self-refresh start mode, the panel self-refresh 2 start mode, the panel self-refresh 2 mode and the panel self-refresh 2 end mode when the image processing is performed, and that the image data read out from the frame buffer is output in a panel self-refresh mode where a still image is displayed by the panel self-refresh, the panel self-refresh end mode, the panel self-refresh 2 mode and the panel self-refresh 2 end mode when the image processing is not performed and in the panel self-refresh mode and the panel self-refresh end mode when the image processing is performed.

8. The image processing device according to claim 1, further including a second image processing circuit configured to perform, on image data output from the fourth switch circuit, image processing applied to an entire region of an image corresponding to the input image data.

9. The image processing device according to claim 1, wherein the first image processing circuit is stopped after the image data having undergone the image processing is written in the frame buffer.

10. An image processing method that causes an image corresponding to input image data to be displayed on an image display device by using a panel self-refresh function including panel self-refresh (PSR) and panel self-refresh 2 (PSR2) by means of an image processing device, the image processing method comprising:

a step of controlling the panel self-refresh function, by means of a panel self-refresh control circuit of the image processing device;

a step of performing, on selected image data, image processing applied to an image corresponding to the selected image data, by means of a first image processing circuit of the image processing device;

a step of generating a switch signal controlling switching of image data, by means of a switch signal generating circuit of the image processing device;

a step of, in response to the switch signal, switching between the input image data and image data read out from a frame buffer through control by the panel self-refresh control circuit so as to output one of the input image data and the image data read out, by means of a first switch circuit of the image processing device;

a step of, in response to the switch signal, switching between the input image data and the image data having undergone the image processing so as to output one of the input image data and the image data having undergone the image processing, by means of a second switch circuit of the image processing device;

a step of, in response to the switch signal, switching between the input image data and the image data having undergone the image processing so as to output one of the input image data and the image data having undergone the image processing, by means of a third switch circuit of the image processing device; and a step of, in response to the switch signal, switching between image data output from the third switch circuit and the image data read out from the frame buffer so as to output one of the image data output from the third switch circuit and the image data read out, by means of a fourth switch circuit of the image processing device, wherein the step of generating the switch signal includes:

a step of generating, as the switch signal, a first switch signal that controls switching of image data in the first switch circuit such that the input image data is output in a normal operation mode where an image corresponding to the input image data is displayed by normal operation, a panel self-refresh start mode where the input image data is written in the frame buffer before the panel self-refresh starts, a panel self-refresh end mode where phase adjustment between the input image data and the image data read out from the frame buffer is carried out before the panel self-refresh ends, and a panel self-refresh 2 start mode where the input image data is written in the frame buffer before the panel self-refresh 2 starts, and the image data read out from the frame buffer is output in a panel self-refresh 2 mode where a still image is displayed by the panel self-refresh 2, and a panel self-refresh 2 end mode where phase adjustment between the input image data and the image data read out from the frame buffer is carried out before the panel self-refresh 2 ends, when the image processing is performed, a step of generating, as the switch signal, a second switch signal that controls switching of image data in the second switch circuit such that the input image data is output in the panel self-refresh start mode, the panel self-refresh end mode, the panel self-refresh 2 start mode and the panel self-refresh 2 end mode when the image processing is not performed, and that the input image data is output in the panel self-refresh 2 start mode and the panel self-refresh 2 end mode, and the image data having undergone the image processing is output in the panel self-refresh start mode and the panel self-refresh end mode, when the image processing is performed, a step of generating, as the switch signal, a third switch signal that controls switching of image data in the third switch circuit such that the input image data is output in the normal operation mode, the panel self-refresh start mode, the panel self-refresh end mode, the panel self-refresh 2 start mode and the panel self-refresh 2 end mode when the image processing is not performed, and that the image data having undergone the image processing is output in the normal operation mode, the panel self-refresh start mode, the panel self-refresh end mode, the panel self-refresh 2 start mode, the panel self-refresh 2 mode and the panel self-refresh 2 end mode when the image processing is performed, and a step of generating, as the switch signal, a fourth switch signal that controls switching of image data in the fourth switch circuit such that image data output from the third switch circuit is output in the normal operation mode, the panel self-refresh start mode and the panel self-refresh 2 start mode when the image processing is not performed and in the normal operation mode, the panel self-refresh start mode, the panel self-refresh 2 start mode, the panel self-refresh 2 mode and the panel self-refresh 2 end mode when the image processing is performed, and that the image data read out from the frame buffer is output in a panel self-refresh mode where a still image is displayed by the panel self-refresh, the panel self-refresh end mode, the panel self-refresh 2 mode and the panel self-refresh 2 end mode when the image processing is not performed and in the panel self-refresh mode and the panel self-refresh end mode when the image processing is performed.

* * * * *